US011819178B2

(12) United States Patent
Conrad

(10) Patent No.: US 11,819,178 B2
(45) Date of Patent: Nov. 21, 2023

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 383 days.

(21) Appl. No.: 16/199,777

(22) Filed: Nov. 26, 2018

(65) Prior Publication Data

US 2020/0163503 A1 May 28, 2020

(51) Int. Cl.

| | |
|---|---|
| ***A47L 5/24*** | (2006.01) |
| ***A47L 9/28*** | (2006.01) |
| ***A47L 9/32*** | (2006.01) |
| ***A47L 9/16*** | (2006.01) |
| ***A47L 5/28*** | (2006.01) |

(52) U.S. Cl.

CPC ..... *A47L 5/24* (2013.01); *A47L 5/28* (2013.01); *A47L 9/1666* (2013.01); *A47L 9/2884* (2013.01); *A47L 9/322* (2013.01); *A47L 9/1608* (2013.01); *A47L 9/1683* (2013.01); *A47L 9/2857* (2013.01)

(58) Field of Classification Search

CPC . A47L 5/24; A47L 5/28; A47L 9/1666; A47L 9/2884; A47L 9/322; A47L 9/1608; A47L 9/1683; A47L 9/2857; A47L 9/122; A47L 9/2889; A47L 9/2868

USPC ..... 15/344

See application file for complete search history.

(56) References Cited

U.S. PATENT DOCUMENTS

| | | | |
|---|---|---|---|
| 7,507,269 | B2 | 3/2009 | Murphy et al. |
| 7,882,593 | B2 | 2/2011 | Beskow et al. |
| 7,958,597 | B2 | 6/2011 | Frantzen et al. |
| 8,069,529 | B2 | 12/2011 | Groff et al. |
| 8,156,609 | B2 | 4/2012 | Milne et al. |

(Continued)

FOREIGN PATENT DOCUMENTS

| | | | |
|---|---|---|---|
| CN | 108024674 | 5/2018 | |
| CN | 108113571 A * | 6/2018 | ..... A47L 5/24 |

(Continued)

OTHER PUBLICATIONS

Operating Manual: Dyson Stick V10 absolute vacuum user guide, copyright at least as early as Mar. 2018.

(Continued)

*Primary Examiner* — Kristina N Junge
*Assistant Examiner* — Michael A Gump
(74) *Attorney, Agent, or Firm* — Philip C. Mendes da Costa; BERESKIN & PARR LLP/ S.E.N.C.R.L., s.r.l.

(57) ABSTRACT

A hand vacuum cleaner has an airflow path from an air inlet to a clean air outlet with an air treatment member and a fan and motor assembly in the air flow path. The hand vacuum cleaner has a cleaner body and a handle having a hand grip portion. The hand vacuum cleaner also includes a plurality of batteries. A portion of the motor and fan assembly and/or a portion of a filter component can be positioned between at least some of the batteries. The batteries may be contained in a removable storage chamber. The storage chamber may be removably mounted to the hand vacuum cleaner around at least a portion of a filter and/or fan and motor assembly.

19 Claims, 32 Drawing Sheets

(56) References Cited

U.S. PATENT DOCUMENTS

| | | | | |
|---|---|---|---|---|
| 8,347,455 | B2 | 1/2013 | Dyson et al. | |
| 8,424,154 | B2 | 4/2013 | Beskow et al. | |
| 8,549,704 | B2 | 10/2013 | Milligan et al. | |
| 8,607,406 | B2 | 12/2013 | Miefalk et al. | |
| 8,607,407 | B2 | 12/2013 | Conrad | |
| 8,769,764 | B2 | 7/2014 | Crouch et al. | |
| 8,806,702 | B2 * | 8/2014 | Wolfe, Jr. | A47L 9/2878 15/319 |
| 9,204,769 | B2 | 12/2015 | Conrad | |
| 9,314,139 | B2 | 4/2016 | Conrad et al. | |
| 9,757,001 | B2 * | 9/2017 | Hwang | A47L 5/28 |
| 9,888,817 | B2 | 2/2018 | Conrad | |
| 9,986,880 | B2 | 6/2018 | Conrad | |
| 2006/0090290 | A1 * | 5/2006 | Lau | A47L 7/04 15/344 |
| 2008/0040883 | A1 * | 2/2008 | Beskow | A47L 9/165 15/329 |
| 2011/0289720 | A1 | 12/2011 | Han et al. | |
| 2013/0091815 | A1 * | 4/2013 | Smith | A47L 9/106 55/346 |
| 2014/0237757 | A1 | 8/2014 | Conrad | |
| 2017/0196426 | A1 | 7/2017 | Brown et al. | |
| 2017/0209014 | A1 * | 7/2017 | Stickney | A47L 9/242 |
| 2019/0008338 | A1 | 1/2019 | Conrad | |
| 2020/0077855 | A1 * | 3/2020 | Brown | A47L 9/2842 |
| 2020/0129028 | A1 * | 4/2020 | Pougher | A47L 9/2884 |
| 2020/0154962 | A1 * | 5/2020 | Fie | H01M 2/1055 |
| 2020/0178742 | A1 * | 6/2020 | Tanaka | A47L 9/0411 |
| 2022/0117450 | A1 * | 4/2022 | Lageat | A47L 9/2884 |

FOREIGN PATENT DOCUMENTS

| | | | | |
|---|---|---|---|---|
| CN | 112533520 | A | 3/2021 | |
| EP | 3108788 | A1 * | 12/2016 | A47L 9/2889 |
| WO | 2017046557 | A1 | 3/2017 | |
| WO | 2017046559 | A1 | 3/2017 | |
| WO | 2017046560 | A1 | 3/2017 | |
| WO | 2019/030479 | A1 | 2/2019 | |

OTHER PUBLICATIONS

Google Patents: English machine translation of CN112533520, published on Mar. 19, 2021.

Espacenet: English machine translation of CN108024674, published on May 11, 2018.

* cited by examiner

SURFACE CLEANING APPARATUS

FIELD

This disclosure relates generally to surface cleaning apparatus such as hand vacuum cleaners, upright vacuum cleansers, stick vacuum cleaners or canister vacuum cleaners, and in particular portable surface cleaning apparatus, such as hand vacuum cleaners, with components nested with an onboard energy source.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuum cleaners. Further, various designs for cyclonic surface cleaning apparatus, including battery operated cyclonic hand vacuum cleaners are known in the art.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, it may be desirable for a hand vacuum cleaner to have a compact overall form, for example so it can be maneuvered around and/or between objects when being carried by a user while cleaning one or more surfaces. A compact form may also improve the ergonomics of the hand vacuum cleaner (e.g. the perceived balance or 'hand feel' when carried by a user) and well as permit the hand vacuum cleaner to be stored in a smaller place.

A hand vacuum cleaner may be powered by an onboard energy source comprising a plurality of energy storage members, such as one or more batteries provided in one or more battery packs, that allows the hand vacuum cleaner to be used more freely without a tether (an electric cord) limiting the range or maneuverability. Nesting some or all of the fan and motor assembly and/or a pre-motor filter and/or a post-motor filter between onboard energy storage members may promote a compact design and reduce the overall size of the hand vacuum cleaner. This may provide increased maneuverability and accessibility for a user of the hand vacuum cleaner.

In accordance with this broad aspect, there is provided a hand vacuum cleaner having a front end, a rear end, an upper end and a lower end, the hand vacuum cleaner comprising:

(a) an air flow path from an air inlet to a clean air outlet with an air treatment member and a fan and motor assembly in the air flow path, the motor and fan assembly having a motor axis of rotation;

(b) a hand vacuum cleaner body;

(c) a handle having a hand grip portion; and, (d) a plurality of batteries wherein at least a portion of the motor and fan assembly is located between at least some of the batteries.

In some embodiments, a filter may be provided in the air flow path, wherein at least a portion of the filter is located between at least some of the batteries.

In some embodiments, an open volume may be provided between as least some of the batteries and at least the portion of the motor and fan assembly is located in the open volume.

In some embodiments, a filter may be provided in the air flow path, wherein at least a portion of the filter is located in the open volume.

In some embodiments, the motor and fan assembly has first and second lateral sides which are spaced apart in a lateral direction on opposite sides of the axis of rotation, where at least first and second axially extending rows of batteries may be provided on one lateral side and at least a first axially extending row of batteries may be provided on the other lateral side, where the first axially extending row may be spaced from the second axially extending row in a transverse direction that is perpendicular to both the axis of rotation and the lateral direction.

In some embodiments, the motor and fan assembly has first and second lateral sides which are spaced apart in a lateral direction on opposite sides of the axis of rotation, at least first and second axially extending rows of batteries may be provided on each lateral side of the motor and fan assembly, where the first axially extending row may be spaced from the second axially extending row in a transverse direction that is perpendicular to both the axis of rotation and the lateral direction.

In some embodiments, the second lateral row of batteries may be longer than the first lateral row of batteries.

In some embodiments, the batteries may be provided in an array having first and second lateral array sides, first and second transverse array sides and first and second axially spaced apart array sides, where the first row of batteries may be located at the first transverse array side and the second row may be located at the second transverse array side, where a filter is provided in the air flow path and a first portion of the filter may be positioned between the second transverse array side and the first row of batteries.

In some embodiments, a filter may be provided in the air flow path and the filter may be transversely positioned overlying at least one of the first rows of batteries.

In some embodiments, a filter may be provided in the air flow path and the filter may be a pre-motor filter and the axis of rotation may extend through a volume defined by a perimeter of the pre-motor filter.

In some embodiments, the filter may be a pre-motor filter, the axis of rotation may extend through a volume defined by a perimeter of the pre-motor filter and a second portion of the filter may be positioned between the first rows of batteries.

In some embodiments, a post-motor filter may be provided and the axis of rotation may extend through a volume defined by a perimeter of the post-motor filter.

In some embodiments, an axis of at least one of the first rows of batteries may extend through the volume defined by a perimeter of the post-motor filter.

In some embodiments, an axis of at least one of the second rows of batteries may extend through the volume defined by a perimeter of the post-motor filter.

In some embodiments, the plurality of batteries are located in a battery housing and the plurality of batteries may be positioned exterior to the air flow path.

In some embodiments, the handle may be located at the rear end of the hand vacuum cleaner, the handle may have a handle axis extending between upper and lower ends of the handle and the plurality of batteries and the motor and fan assembly may be positioned at the lower end of the handle.

In some embodiments, the handle may be located at the rear end of the hand vacuum cleaner, the handle may have a handle axis extending between upper and lower ends of the handle and the plurality of batteries and the motor and fan assembly may be positioned at the upper end of the handle.

In some embodiments, the plurality of batteries may be located in a removable battery housing.

In accordance with this broad aspect, there is also provided a hand vacuum cleaner having a front end, a rear end, an upper end and a lower end, the hand vacuum cleaner comprising:

(e) an air flow path from an air inlet to a clean air outlet with an air treatment member, a filter and a fan and motor assembly in the air flow path, the motor and fan assembly having a motor axis of rotation;

(f) a hand vacuum cleaner body;

(g) a handle having a hand grip portion; and, (h) a plurality of batteries wherein at least a portion of the filter is located between at least some of the batteries.

In some embodiments, an open volume is provided between as least some of the batteries and at least the portion of the filter may be located in the open volume.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
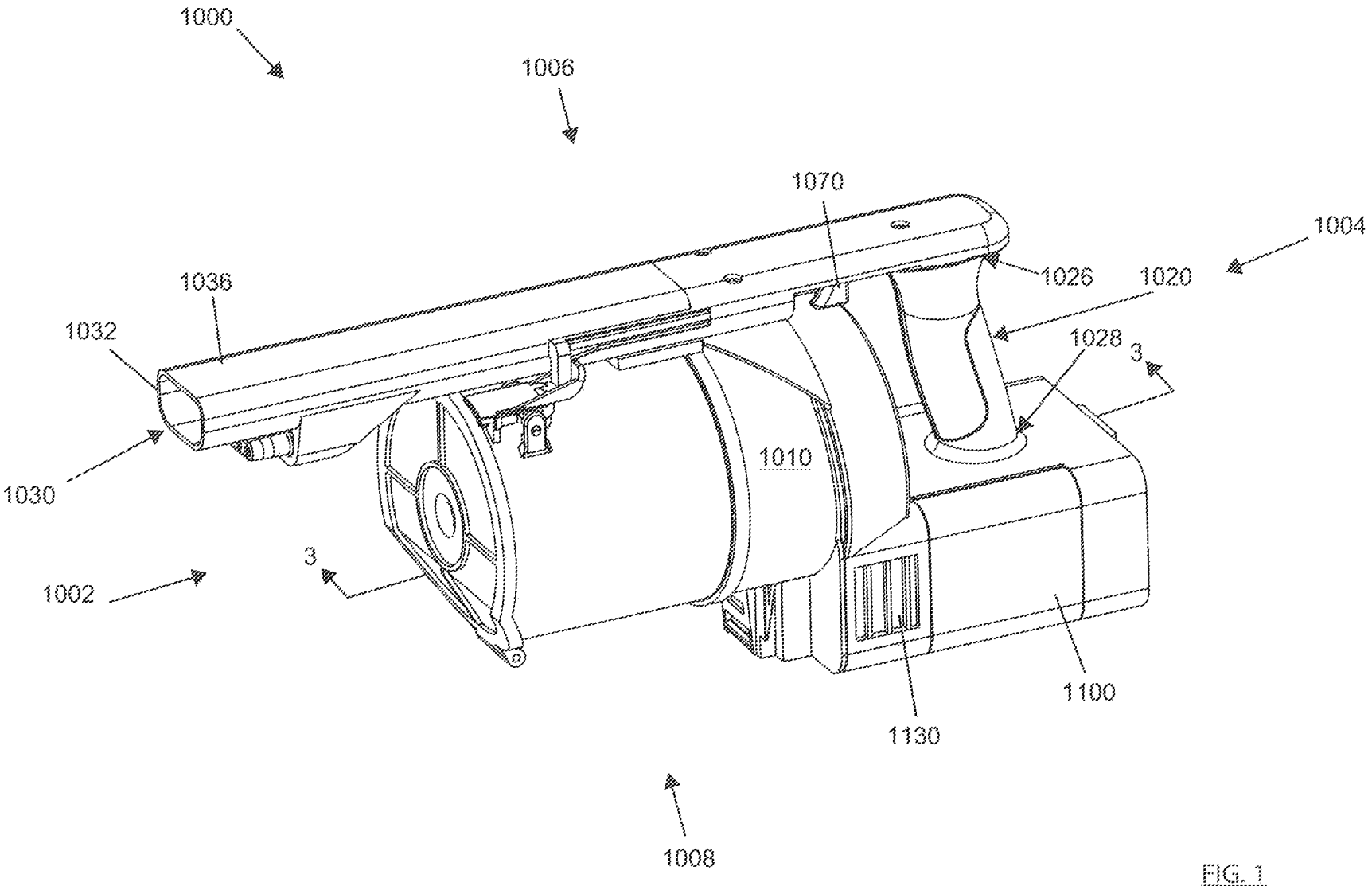
FIG. 1 is a top front perspective view of a hand vacuum cleaner in accordance with an embodiment.
Figure 2:
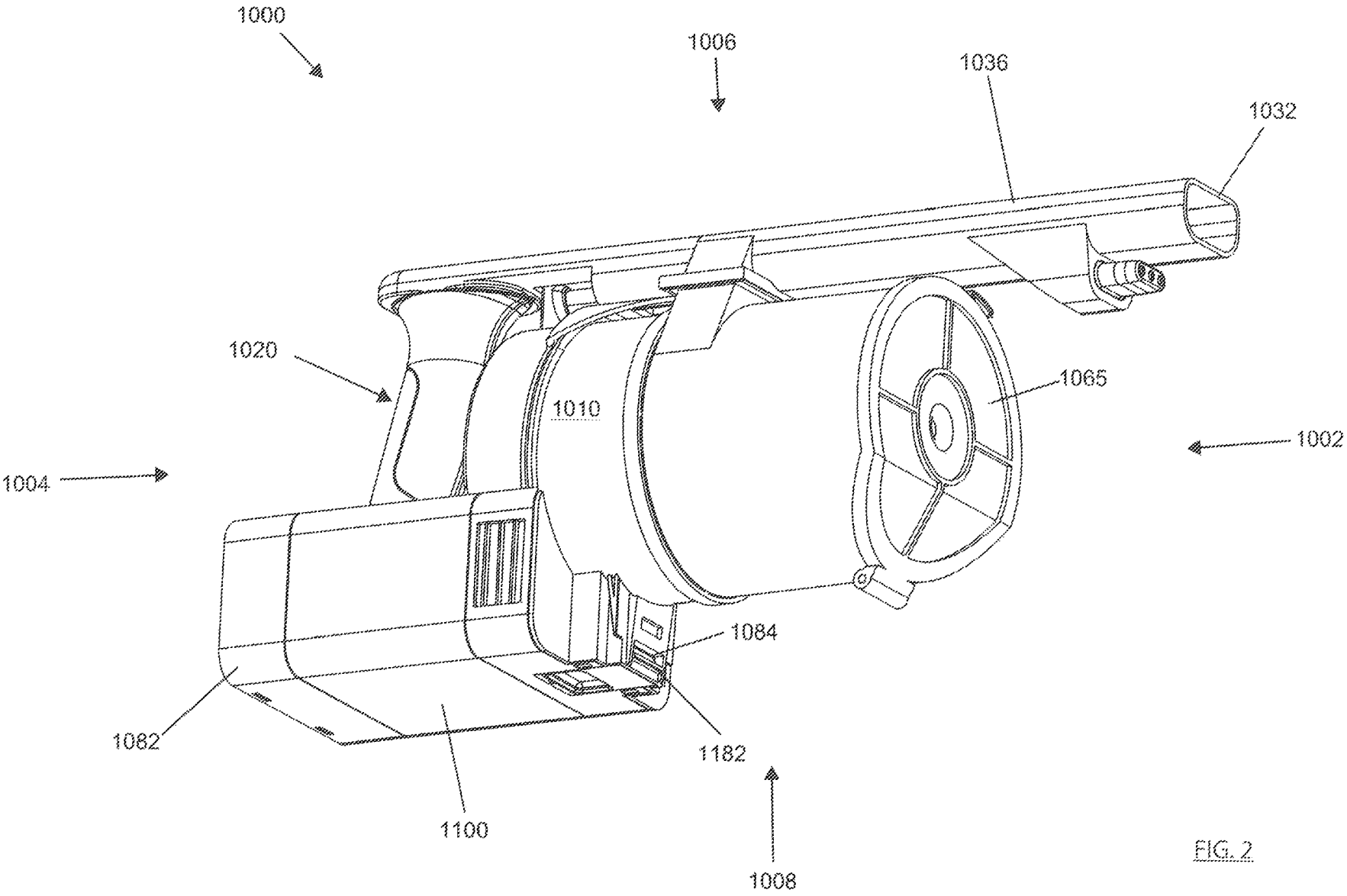
FIG. 2 is a bottom front perspective view of the hand vacuum cleaner of FIG. 1.
Figure 3:
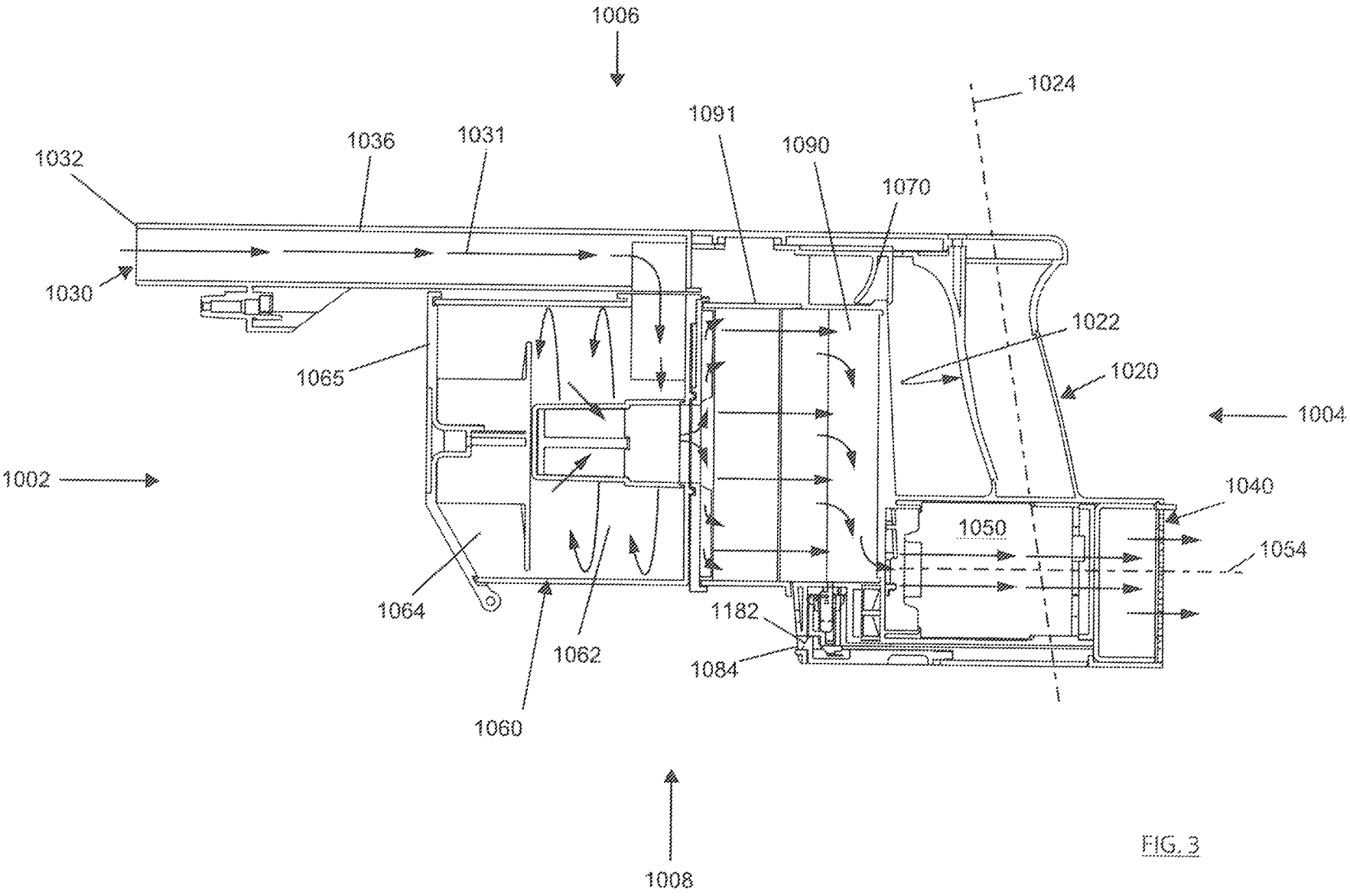
FIG. 3 is a cross-sectional view of the hand vacuum cleaner of FIG. 1 along line 3-3.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

Referring to FIGS. 1 to 5, an exemplary embodiment of a surface cleaning apparatus is shown generally as 1000. The surface cleaning apparatus 1000 shown includes an energy storage chamber 1100 that is shaped so that one or more of the suction motor 1050, pre-motor filter 1090 and post-motor filter 1080 can be nested between onboard energy storage members 1150.

In the illustrated embodiment, the surface cleaning apparatus is a hand vacuum cleaner, which may also be referred to also as a "handvac" or "hand-held vacuum cleaner". As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g. a floor) during use. It will be appreciated that surface cleaning apparatus 1000 may alternately be any surface cleaning apparatus, such as an upright surface cleaning apparatus, a stick vac, a canister surface cleaning apparatus, an extractor or the like. It will also be appreciated that the surface cleaning apparatus may use any configuration of the operating components and the airflow paths exemplified herein.

As exemplified in FIGS. 1 to 5, surface cleaning apparatus 1000 includes a main body 1010 having a housing, a handle 1020, an air treatment member 1060 connected to the main body 1010, a dirty air inlet 1030, a clean air outlet 1040, and an air flow path 1031 extending between the dirty air inlet 1030 and the clean air outlet 1040, which may be referred to as a first or primary air flow path.

Surface cleaning apparatus 1000 has a front end 1002, a rear end 1004, an upper end or top 1006, and a lower end or bottom 1008. In the embodiment shown, dirty air inlet 1030 is at an upper portion of the front end 1002 and clean air outlet 1040 is at a lower portion of the rear end 1004. It will be appreciated that the dirty air inlet 1030 and the clean air outlet 1040 may be provided in different locations.

A motor and fan assembly is provided to generate vacuum suction through the first air flow path 1031. In the example shown, the motor and fan assembly is a suction motor 1050. The suction motor 1050 is contained within a suction motor housing 1052. The suction motor 1050 is positioned downstream from the air treatment member 1060 although it may be positioned upstream of the air treatment member 1060 (e.g., a dirty air motor) in alternative embodiments. The suction motor 1050 can rotate about a central axis of rotation 1054.

The air treatment member 1060 is configured to remove particles of dirt and other debris from the airflow and/or otherwise treat the airflow. Any air treatment member or members known in the art may be used. For example, the surface cleaning apparatus may use one or more cyclones, bags, screens, physical filter media (e.g., foam, felt, HEPA) or the like.

As exemplified, the air treatment member 1060 includes a cyclone assembly having a single cyclonic cleaning stage with a single cyclone chamber 1062. In the example shown, the dirt collection region 1064 is external to the cyclone chamber 1062, although in alternative embodiments the dirt collection region 1064 may be, e.g., a lower portion of the cyclone chamber 1062. The cyclone chamber 1062 and dirt collection region 1064 may be of any configuration suitable for separating dirt from an air stream and collecting the separated dirt, respectively. The cyclone chamber 1062 may be oriented in any direction. Optionally, as exemplified, the cyclone chamber 1062 may include an openable front door 1065.

In alternative embodiments, the cyclone assembly may include two or more cyclonic cleaning stages arranged in series with each other. Each cyclonic cleaning stage may include one or more cyclone chambers that may be arranged in parallel with each other and one or more dirt collection chambers, of any suitable configuration. The dirt collection chamber or chambers may be external to the cyclone chambers, or may be internal the cyclone chamber and configured as a dirt collection area or region within the cyclone chamber.

Hand vacuum cleaner 1000 may include a pre-motor filter 1090 that may be provided in a pre-motor filter housing 1091. Pre-motor filter housing 1091 may be provided in the air flow path downstream of the air treatment member 1060 and upstream of the suction motor 1050. Pre-motor filter housing 1091 may be of any suitable construction, including any of those exemplified herein. Pre-motor filter 1090 may be formed from any suitable physical, porous filter media and may have any suitable shape, including the examples disclosed herein with respect to a removable pre-motor filter assembly. For example, the pre-motor filter may be one or more of a foam filter, felt filter, HEPA filter, other physical filter media, electrostatic filter, and the like. Optionally, the pre-motor filter housing may be openable to allow the pre-motor filter to be cleaned and/or replaced.

The axis 1054 of the suction motor 1050 may extend through a volume defined by the outer perimeter of the pre-motor filter (e.g., if the pre-motor filter is in the shape of a longitudinally extending cylinder having an open interior volume such that the pre-motor filter is annular in a plane transverse to the longitudinal direction) and may extend through a portion of the pre-motor filter 1090 (e.g., if the pre-motor filter has a solid interior as exemplified). Accordingly, as exemplified in FIG. 21, the axis 1054 of the suction motor 1050 extends through a volume defined by the outer perimeter of the pre-motor filter and through a portion of the pre-motor filter 1090. After passing through the pre-motor filter 1090, air may travel, e.g., generally rearwardly from the pre-motor filter 1090 to an inlet end of the suction motor 1050. An advantage of this arrangement is that, by promoting air to travel in this manner, the need for air flow direction changes between an air outlet of the pre-motor filter 1090 and the suction motor 1050 may be reduced or eliminated, thereby reducing backpressure and/or air flow losses through this portion of the hand vacuum cleaner. It will be appreciated that, in some embodiment, the pre-motor filter may be positioned above or below the axis 1054 of the suction motor 1050.

As exemplified, hand vacuum cleaner 1000 may also include a post-motor filter 1080. The post-motor filter 1080 may be contained within a post-motor filter housing 1082. Optionally, the post-motor filter housing 1082 may be openable to allow the post-motor filter 1080 to be cleaned and/or replaced.

The post-motor filter 1080 can be provided in the air flow path downstream of the suction motor 1050 and upstream of the clean air outlet 1040. Post-motor filter 1080 may be formed from any suitable physical, porous filter media and having any suitable shape, including the examples disclosed herein. In alternative embodiments, the post-motor filter may be any suitable type of filter such as one or more of a foam filter, felt filter, HEPA filter, other physical filter media, electrostatic filter, and the like.

As with the pre-motor filter 1090, the axis 1054 of suction motor 1050 may extend through a volume defined by the outer perimeter of the post-motor filter 1080 and may also pass through a portion of the post-motor filter 1080. Air passing through the suction motor 1050 may then travel rearwardly through the post-motor filter 1080 and out the clean air outlet 1040. This may further reduce backpressure and/or air flow losses through this portion of the hand vacuum cleaner 1000. It will be appreciated that, in some embodiment, the post-motor filter 1080 may be positioned above or below the axis 1054 of the suction motor 1050.

In the illustrated embodiment, the dirty air inlet 1030 of the hand vacuum cleaner 1000 is the inlet end 1032 of an inlet conduit 1036. Optionally, inlet end 1032 of the conduit 1036 can be used as a nozzle to directly clean a surface. Alternatively, or in addition to functioning as a nozzle, inlet conduit 1036 may be connected or directly connected to the downstream end of any suitable accessory tool such as a rigid air flow conduit (e.g., an above floor cleaning wand), a crevice tool, a mini brush, and the like. Accordingly, an assembly comprising a floor cleaning head, a rigid air flow conduit that is moveably mounted to the floor cleaning head at an inlet end of the rigid air flow conduit, and the hand vacuum cleaner disclosed herein, may be provided.

The hand vacuum cleaner also includes a clean air outlet at the outlet end of the airflow path. The clean air outlet may be located at any position on the surface cleaning apparatus. As exemplified, air may exit the hand vacuum cleaner 1000 via a grill located in a lower portion of the main body (e.g., via an air outlet 1040 provided in the rear end of the main body or a sidewall adjacent the rear end). As shown, the clean air outlet 1040 is positioned at the rear of the post-motor filter housing 1082. Alternately, air may exit through an alternate portion of the hand vacuum cleaner, such as an upper portion of the main body (e.g. as shown in FIGS. 29-32).

The handle 1020 may allow a user to control and wield the hand vacuum cleaner 1000. The handle 1020 may include a hand grip portion 1022 that can be grasped by a user's hand when using hand vacuum cleaner 1000. An empty space or void forward of the handle 1020 allows a user's fingers to wrap around the hand grip portion 1022. As exemplified in FIG. 1, the handle may be a pistol grip handle and may be provided at a rearward portion of the hand vacuum cleaner. Optionally, the handle may be the rearward most part of the hand vacuum cleaner.

As exemplified, power may be supplied to the suction motor 1050 and other electrical components of the hand vacuum cleaner 1000 from an onboard power source which may include, for example, one or more batteries 1150 or other energy storage device. One or more energy storage members 1150 can be contained in an energy storage chamber 1100. The energy storage members 1150 function as onboard power sources for the hand vacuum cleaner 1000. In general, the power sources may be any suitable device, including, for example one or more batteries. Optionally, the batteries may be rechargeable or may be replaceable, non-rechargeable batteries.

Optionally, power may be supplied to the hand vacuum cleaner 1000 by an electrical cord connected to the hand vacuum cleaner 1000 (not shown) that can be connected to a standard wall electrical outlet. The power from the electrical cord may also serve to recharge the batteries 1150. In some instances, the batteries 1150 may be recharged while the vacuum cleaner 1000 is operational.

The energy storage chamber 1100 may include any suitable number of energy storage members 1150, and may include, for example, lithium ion battery cells. Any number of cells may be used to create a power source having a desired voltage and current, and any type of battery may be used, including NiMH, alkaline, and the like. Energy storage chamber 1100, which may be referred to as a battery pack, may be electrically connected to the hand vacuum cleaner 1000 by any means known in the art.

The battery pack 1100 may have a power coupling for supplying power (e.g. charging) the cells 1150. Any suitable power coupling may be used, for example, a female coupling configured to receive a male coupling of an electrical cord that is connectable to a source of AC or DC power, such as a household power socket.

Figure 4:
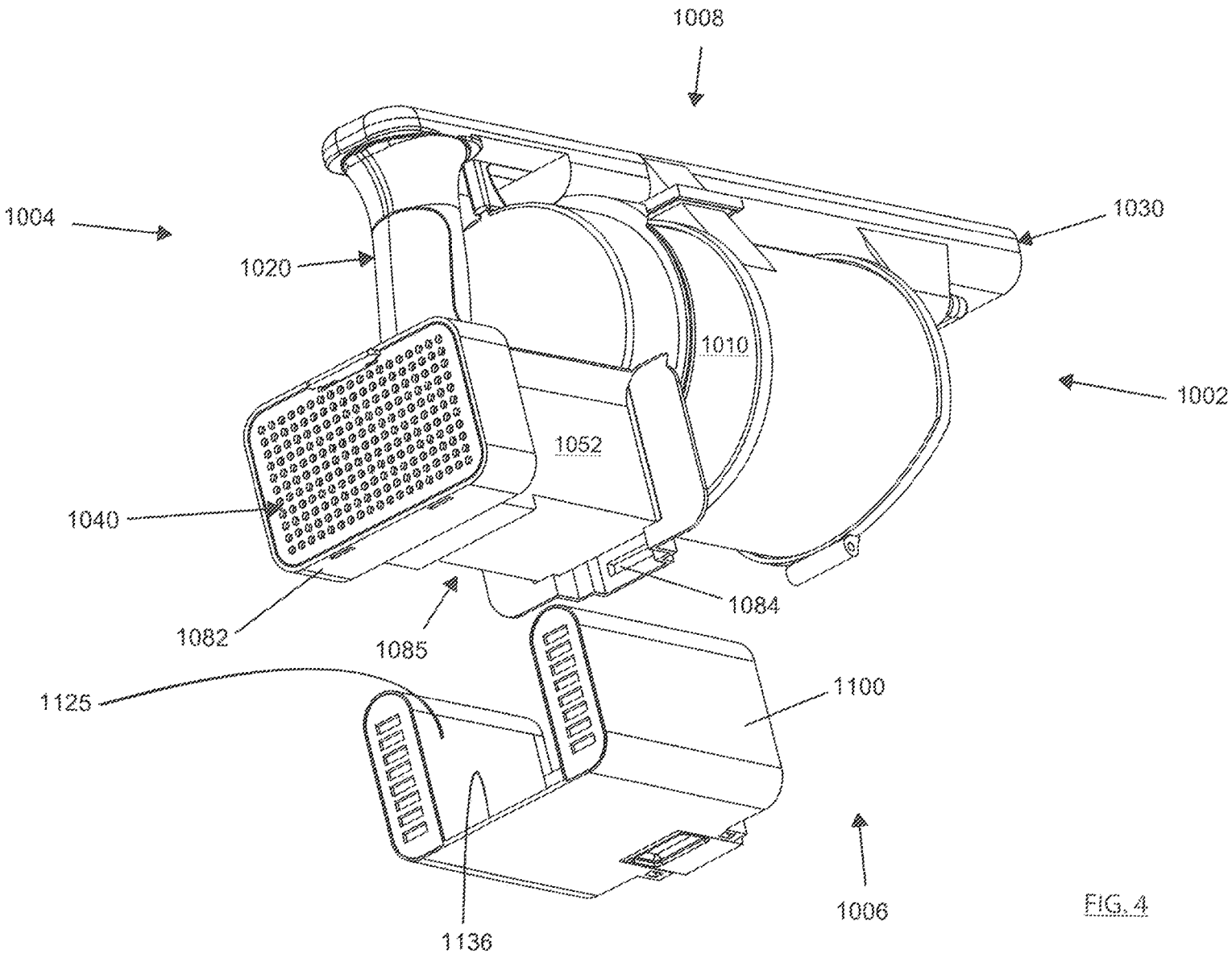
FIG. 4 is a bottom rear perspective view of the hand vacuum cleaner of FIG. 1 with an energy storage chamber removed.
Figure 5:
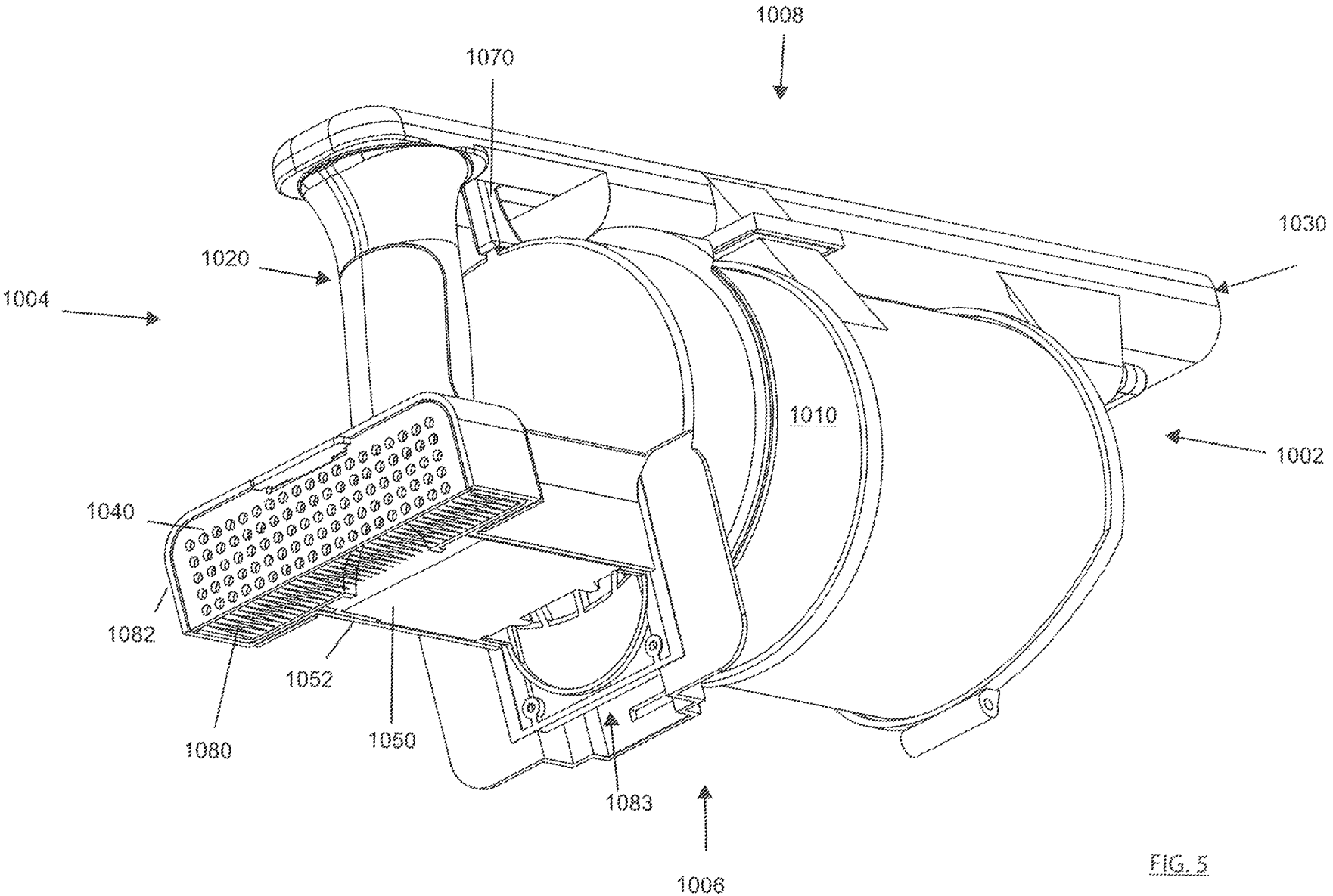
FIG. 5 is a bottom rear perspective view of the hand vacuum cleaner of FIG. 1 with the energy storage chamber removed and a section of the suction motor housing and filter housing removed.

Optionally, as exemplified in FIG. 4, the battery pack 1100 may be removable from the rest of the hand vacuum cleaner 1000 using any mechanism known in the art. In alternative embodiments, the energy storage chamber 1100 may be fixed to the main body 1010 and may not be removable. In such a case, the energy storage chamber 1100 may be openable to allow the batteries to be replaced.

As exemplified in FIG. 4, the energy storage chamber 1100 can be mounted around the suction motor 1050. Accordingly, the energy storage chamber 1100 may substantially surround the bottom and lateral sides of the suction motor housing 1052 when mounted to the hand vacuum cleaner 1000. In such a design, the energy storage chamber 1100 may have an open volume 1110 that is removable receivable around part of the main body 1010 of the hand vacuum cleaner.

As exemplified, the energy storage chamber 1100 seats around part of the suction motor housing 1052 and accordingly, the suction motor housing may remain in position when the energy storage chamber 1100 is removed and may therefore retain suction motor 1050 in position and prevent dirt and debris from entering suction motor 1050 when the energy storage chamber 1100 is removed from hand vacuum cleaner. In some embodiments, a portion of the suction motor 1050 may be outside the perimeter of the energy storage chamber 1100, e.g. above the upper end or ahead of the forward end 1102 of energy storage chamber 1100.

In the embodiment of FIG. 4, the energy storage chamber 1100 is removably mounted in a downward direction. An advantage of this design is that when a user is holding the hand vacuum cleaner by handle 1020, a user may easily remove the battery energy storage chamber 1100.

A further advantage of this design is that the energy storage members may be provided at an outer surface of the hand vacuum cleaner, namely the lateral outer sides of energy storage chamber 1100. Accordingly, the energy storage members may more easily dissipate heat as each energy storage member may be provided adjacent an outer wall.

Additionally or alternatively, the energy storage chamber 1100 may mount around one or more filters in hand vacuum cleaner 1000, such as pre-motor filter 1090 or post-motor filter 1080. When mounted to the hand vacuum cleaner 1000, the exterior of energy storage chamber 1100 can be mounted substantially flush with the exterior of the main body 1010. Accordingly, it will be appreciated that part or all of one or more of the pre-motor filter, the post-motor filter and the suction motor may seat within the open volume when the energy storage chamber is mounted to the hand vacuum cleaner.

Figure 6:
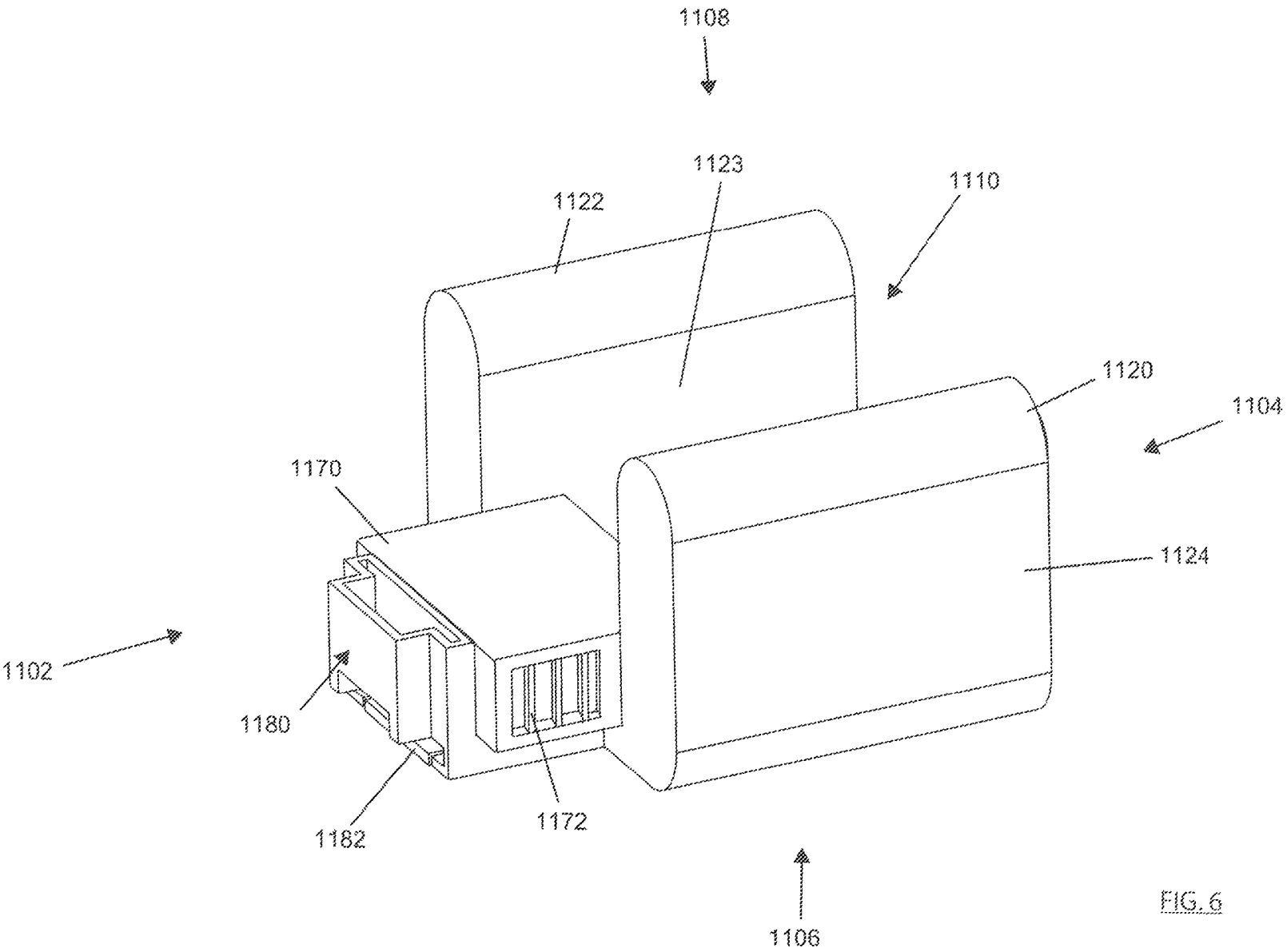
FIG. 6 is a top front perspective view of an energy storage chamber for a hand vacuum cleaner in accordance with an embodiment.

The energy storage chamber 1100 can be mounted in a battery receiving area 1085 defined by the main body 1010 of the hand vacuum cleaner. Any mounting members for enabling a battery pack to be removably mounted may be used. As exemplified, the battery pack 1100 can include a front mounting member 1180 (see FIG. 6). The front mounting member 1180 may engage a corresponding mounting member on the main body 1010 of the hand vacuum cleaner 1000. For instance, the main body 1010 may include a channel 1083 forward of the suction motor 1050 (see FIG. 5). The channel 1083 may be shaped to receive the front mounting member 1180. To mount the energy storage chamber 1100 to the main body 1010, the front portion 1180 can be slid upwards into channel 1083 with the housing 1120 of the energy storage chamber sliding into the battery receiving area 1085.

Alternately, or in addition, the energy storage chamber 1100 and main body 1010 can also include one or more pairs of inter-engageable securement members. The securement members can engage one another to secure the energy storage chamber 1100 to the main body 1010. For instance, the mounting member 1180 may have an extending member or protrusion 1182. Main body 1010 can include a corresponding recess 1084 (see FIG. 4) shaped to engage the extension member 1182. When the battery pack 1100 is mounted to the main body 1010 (i.e. when the front portion 1180 is slid upwards into channel 1183), the extending member 1182 can be received in the recess 1084. The extending member 1182 can engage the base of recess 1084 to retain the battery pack 1100 mounted to the main body 1010.

To remove the energy storage chamber 1100, a user may depress the extending member 1182 so that it recedes from the recess 1084. The energy storage chamber 1100 can then be slid downwards and removed. The extending member 1182 may be biased to its extended position so that the securement members engage automatically as the front portion 1180 slides into place.

In the example shown, the battery pack 1100 includes a mounting member 1180 at the front side only. This may allow a user to detach the battery pack 1100 using only one hand (e.g. using an index finger to depress extending member 1182 while using the palm to support energy storage chamber 1100). The battery pack receiving area 1085 of hand vacuum cleaner 1000 can be shaped to prevent sagging of the rear of battery pack 1100. For instance, the receiving area 1085 can be sized to provide a snug fit with the battery pack 1100. The filter housing 1082 may then prevent the rear 1104 of battery pack 1100 from sagging. In some cases, this may also ensure that any airflow through the housing 1120 can be fluidly coupled into the battery housing 1082 and out the clean air outlet 1040.

In alternative embodiments, the hand vacuum cleaner may include additional mounting members for battery pack 1100. For example, an additional mounting member may be provided on the rear 1104 of battery pack 1100. This may further support the battery pack 1100 and prevent sagging.

In the illustrated embodiment, the hand vacuum cleaner 1000 includes an energy storage chamber 1100 that is mounted to a lower rear portion of the main body 1010. The handle 1020 is located at the rear end 1004 of the hand vacuum cleaner 1000. The handle 1020 extends generally vertically between and upper handle end 1026 and a lower handle end 1028. The energy storage chamber 1100 can be positioned at or below the lower end 1028 of the handle 1020. The suction motor 1050 can also be positioned on the lower rear end of hand vacuum cleaner 1000, at or below the lower end 1028.

The central axis 1024 of the handle 1020 may extend through the suction motor 1050. In the example shown, the axis 1024 intersects the rotational axis 1054 of the suction motor 1050. This may ensure that the weight of the suction motor 1050 is evenly balanced when a user is carrying the hand vacuum cleaner 1000 by handle 1020.

The central axis 1024 of the handle 1020 may also extend through a portion of the energy storage chamber 1100. In the example shown, the central axis 1024 extends through a central vertical plane of the open volume 1110 between the energy storage members 1150 (i.e. through the lateral centerline of the energy storage chamber 1100). The energy storage members 1150 are thus evenly balanced on either lateral side of the central axis 1024.

A power switch 1070 may be provided to selectively control the operation of the suction motor 1050 (e.g. either on/off or variable power levels or both). Operation of the power switch 1070 may control operation of the suction motor 1050 by establishing a power connection between the batteries 1150 and the suction motor 1050. The power switch 1070 may be provided in any suitable configuration and location, including a button, rotary switch, sliding switch, trigger-type actuator, touch pad and the like. In the example shown, the power switch 1070 is positioned proximate to the front side of the hand grip portion 1022. This may allow a user to grasp the hand vacuum cleaner 1000 and selectively control operation of the suction motor 1050 using one hand.

FIGS. 6 to 13 illustrate an exemplary embodiment of the energy storage chamber 1100. The energy storage chamber 1100 includes a plurality of energy storage members 1150 positioned on opposing lateral sides of the energy storage chamber 1100. The suction motor 1050 can nest between the energy storage members 1150 in the open volume, with at least some energy storage members 1150 on a first lateral side 1051 of the suction motor 1050 and at least some energy storage members 1150 on a second lateral side 1053 of the suction motor 1050.

The energy storage chamber 1100 includes a housing 1120. A plurality of energy storage members 1150 are contained within housing 1120. In the example illustrated, the housing 1120 has a first lateral housing section 1122 and a second lateral housing section 1124. Each lateral housing section 1124 encloses one or more energy storage members 1150.

In the example illustrated, each lateral housing section includes two energy storage members 1150. The energy storage members 1150 in each lateral housing section 1122 and 1124 extend generally in a length direction of the energy storage chamber 1100, i.e. between the front 1102 and rear 1104 of the energy storage chamber 1100. As exemplified, this is also the direction of the suction motor axis and the cyclone axis of rotation. The interior of the lateral housing sections 1122 and 1124 may include alignment members to maintain the batteries 1150 in place in the lateral housing sections 1122 and 1124.

Figure 8:
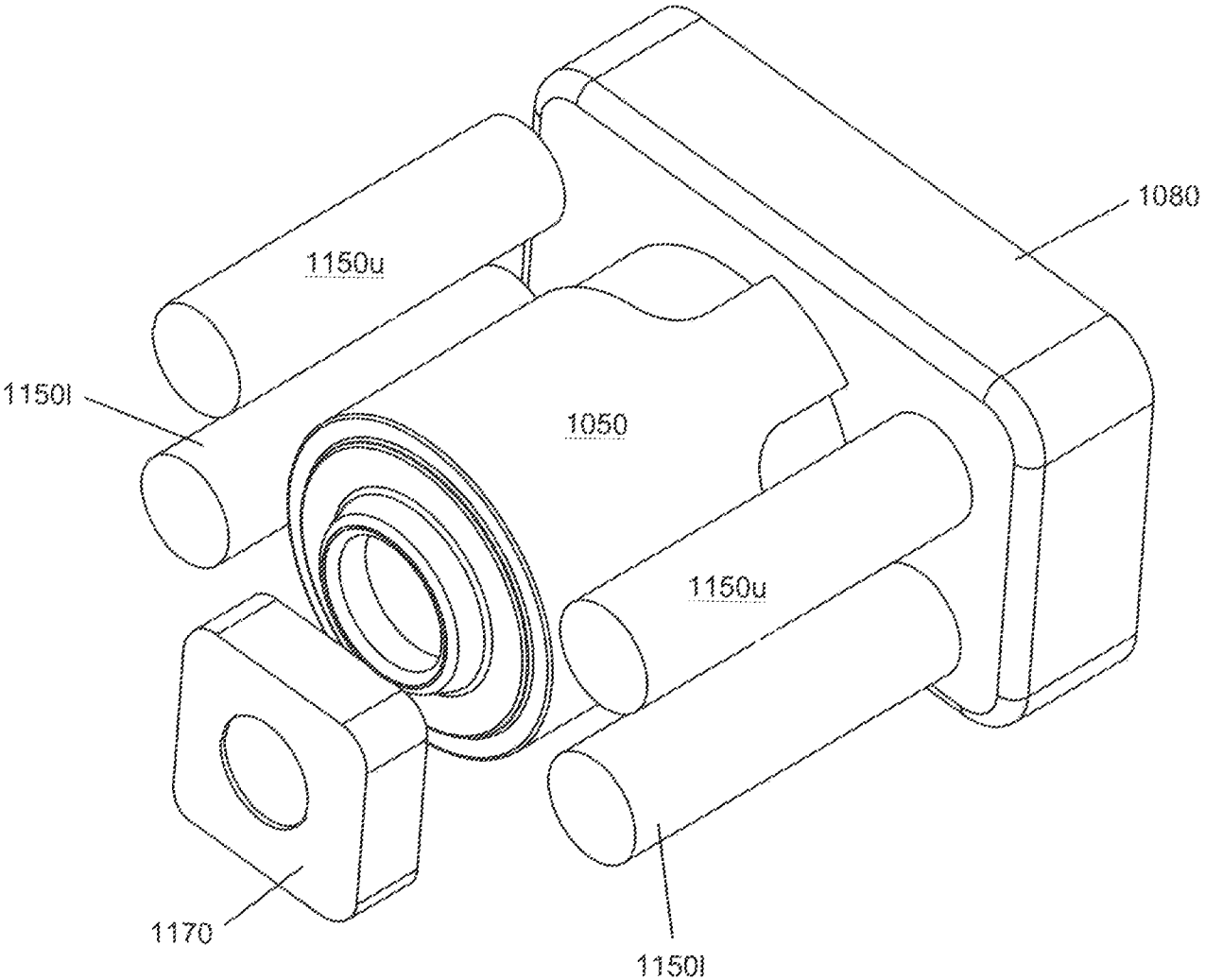
FIG. 8 is a front perspective view of the energy storage chamber, suction motor and post-motor filter of FIG. 7 with a housing of the energy storage chamber and the suction motor removed.
Figure 9:
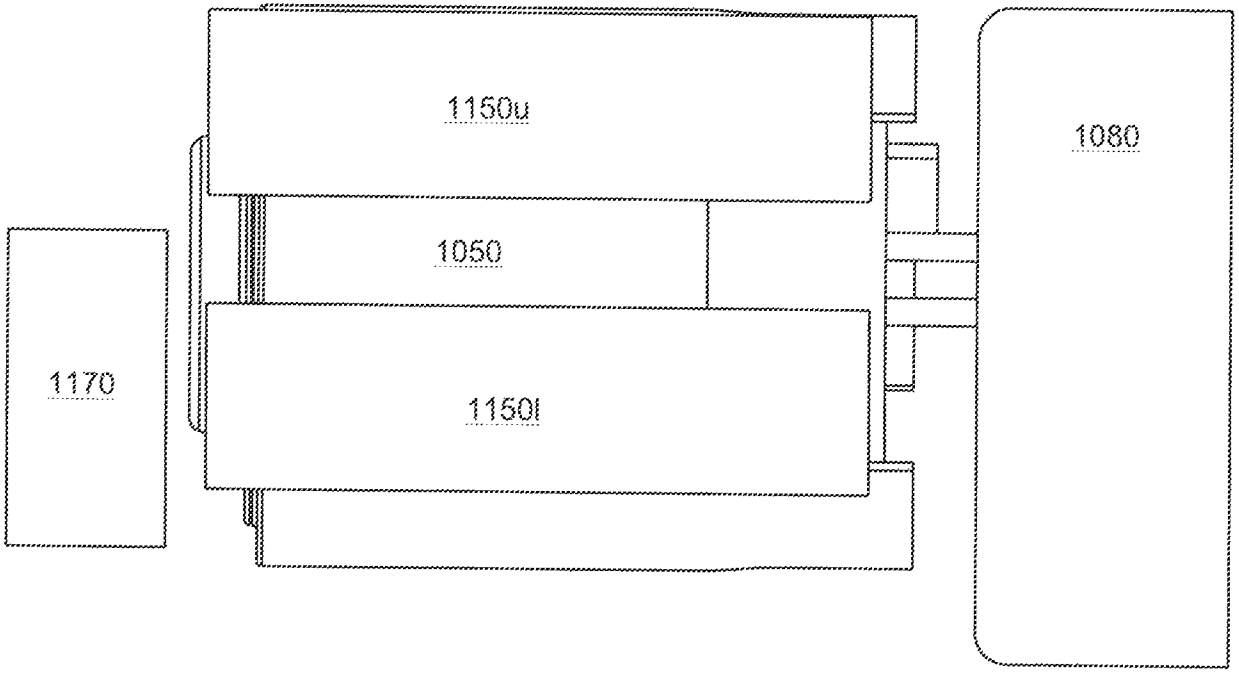
FIG. 9 is a side view of the energy storage chamber, suction motor and post-motor filter of FIG. 8.

The energy storage members 1150 can be arranged into separate rows within the lateral housing sections 1122 and 1124. As shown in the example of FIG. 8, an upper row of energy storage members 1150*u* and a lower row of energy storage members 1150*l* are contained within each lateral housing section 1122 and 1124. Each row of energy storage members 1150 extends substantially in parallel with the motor and fan assembly, i.e. substantially parallel to the motor axis of rotation 1054.

In the example shown, the rows of energy storage members are substantially the same length. Alternatively, the rows can have different lengths. In some cases, one or more rows of energy storage members may have different sizes or numbers of energy storage members (see e.g. FIGS. 20-22), which may allow various components of hand vacuum cleaner 1000 to nest within the energy storage chamber 1100.

Figure 10:
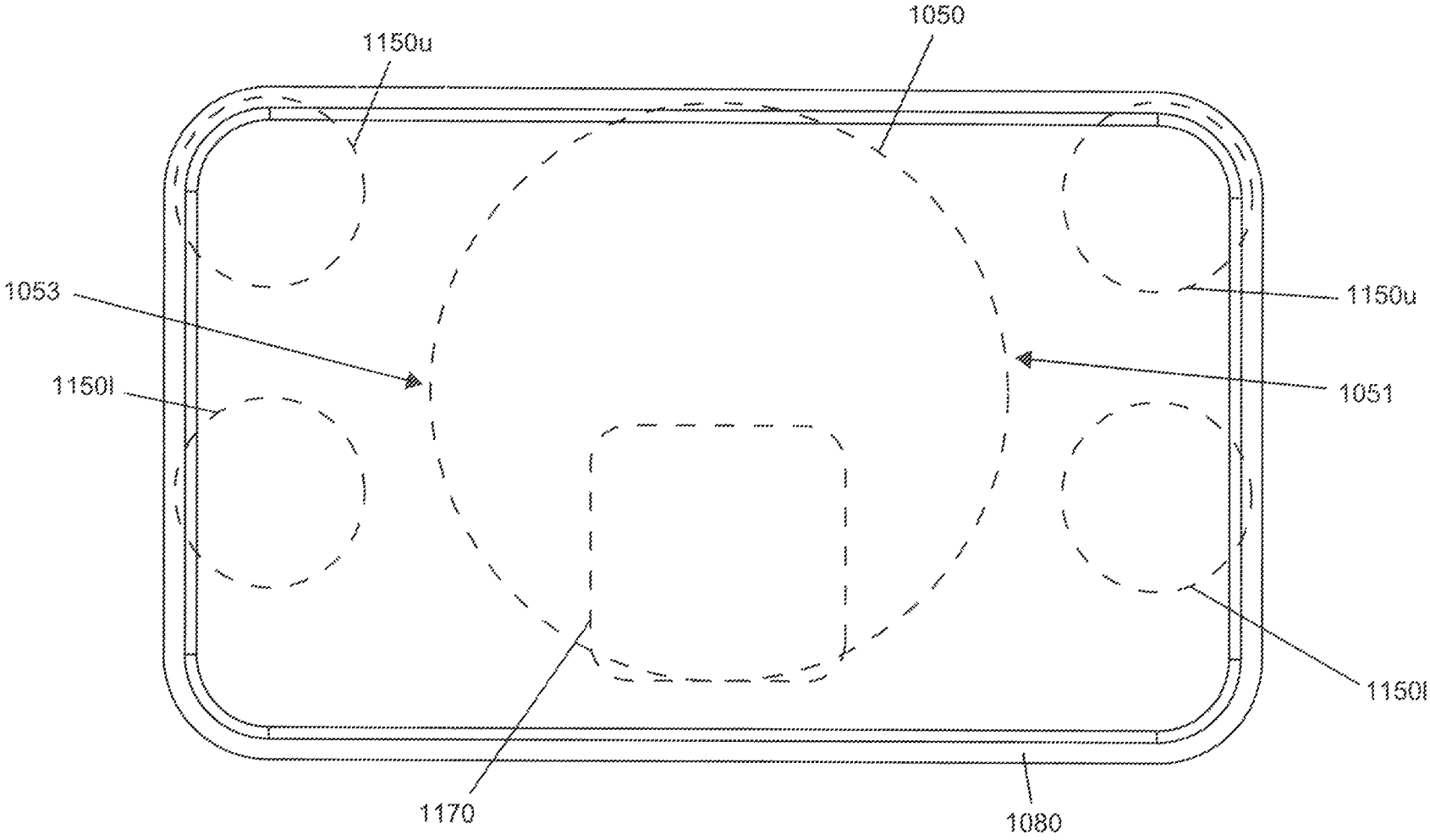
FIG. 10 is a rear view of the energy storage chamber, suction motor and post-motor filter of FIG. 8.
Figure 11:
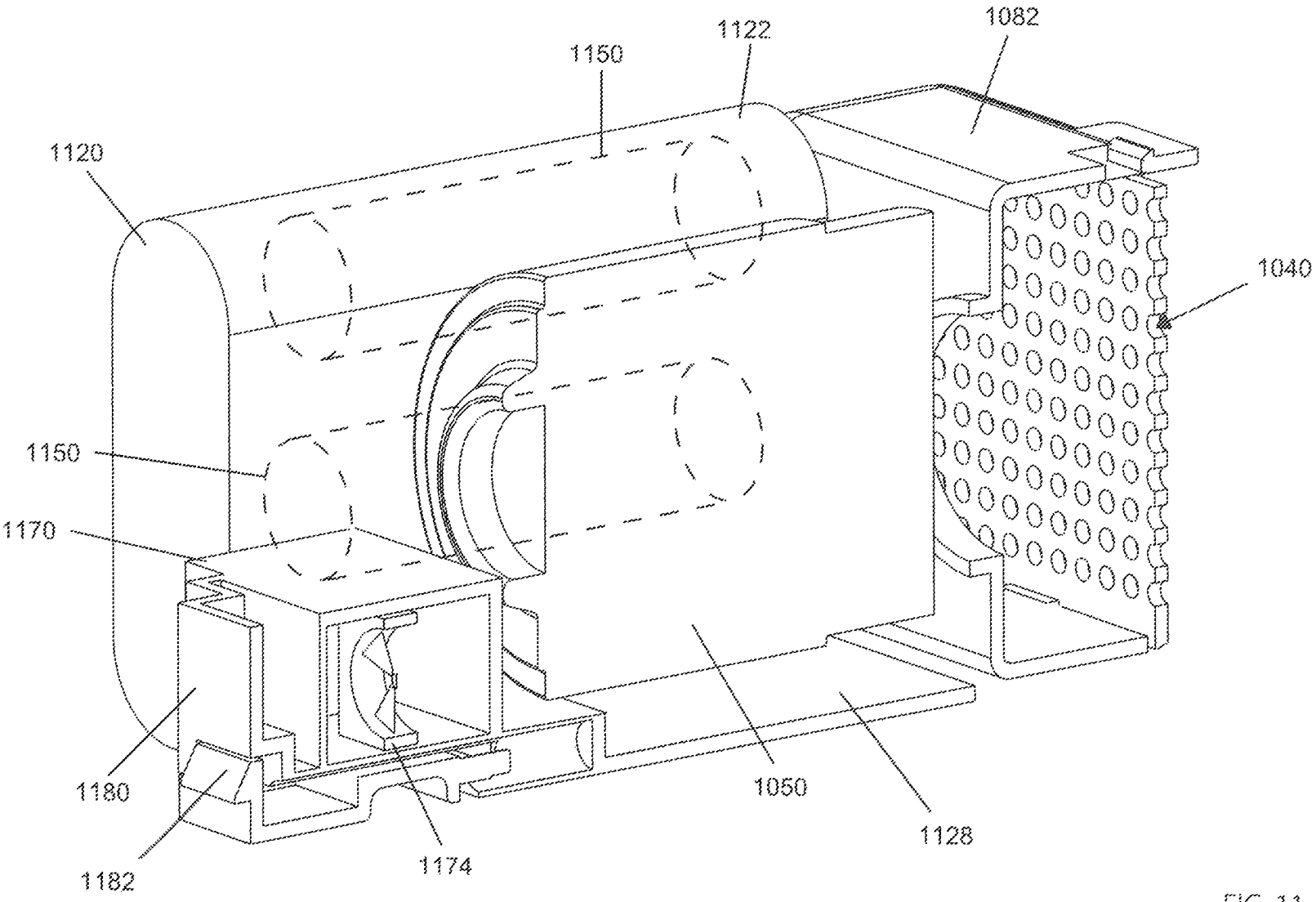
FIG. 11 is a perspective sectional view of the energy storage chamber, suction motor and post-motor filter of FIG. 7, taken along line 11-11 in FIG. 7.
Figure 12:
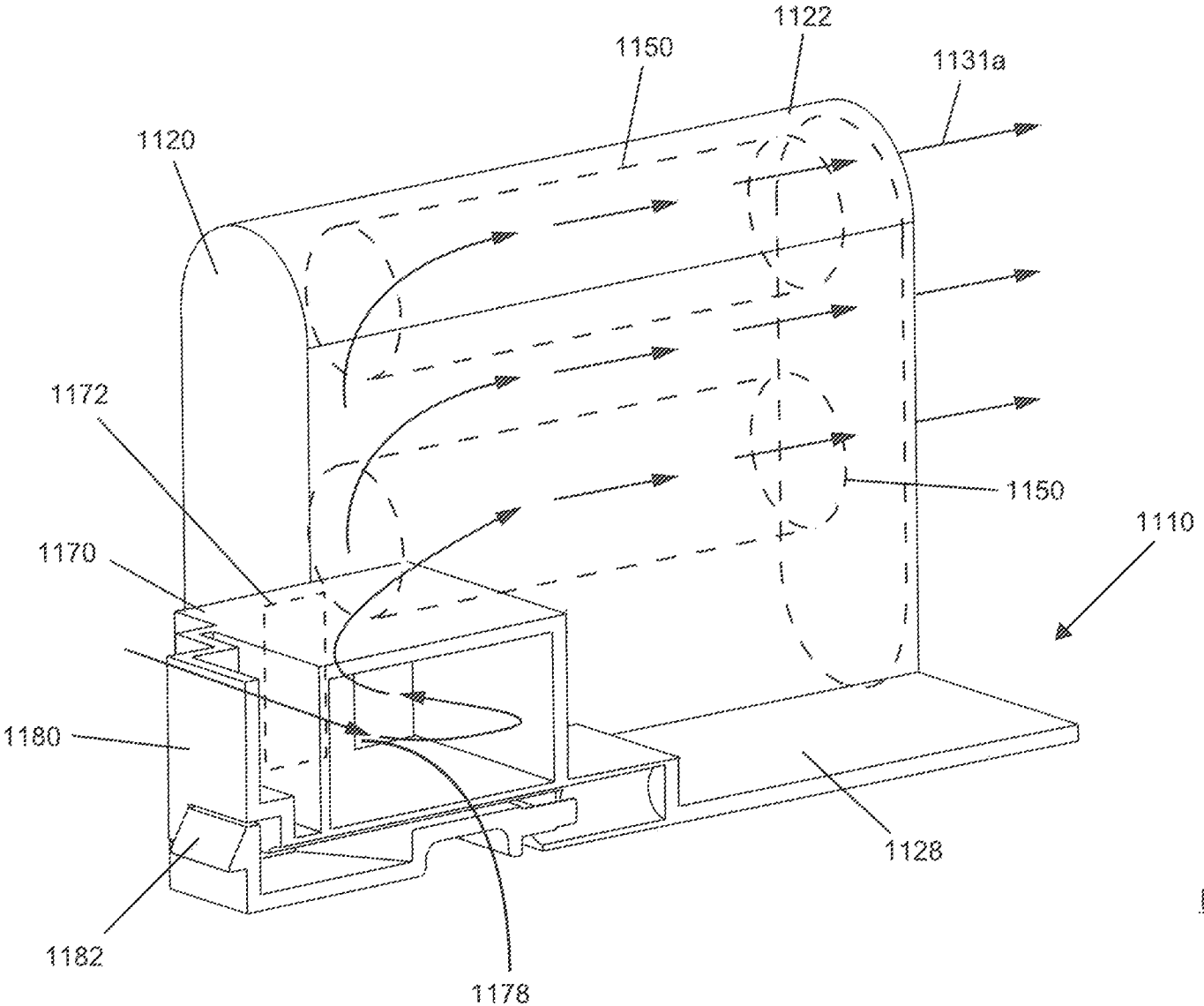
FIG. 12 is a perspective sectional view of the energy storage chamber of FIG. 7, taken along line 11-11 in FIG. 7, with a fan unit removed.
Figure 13:
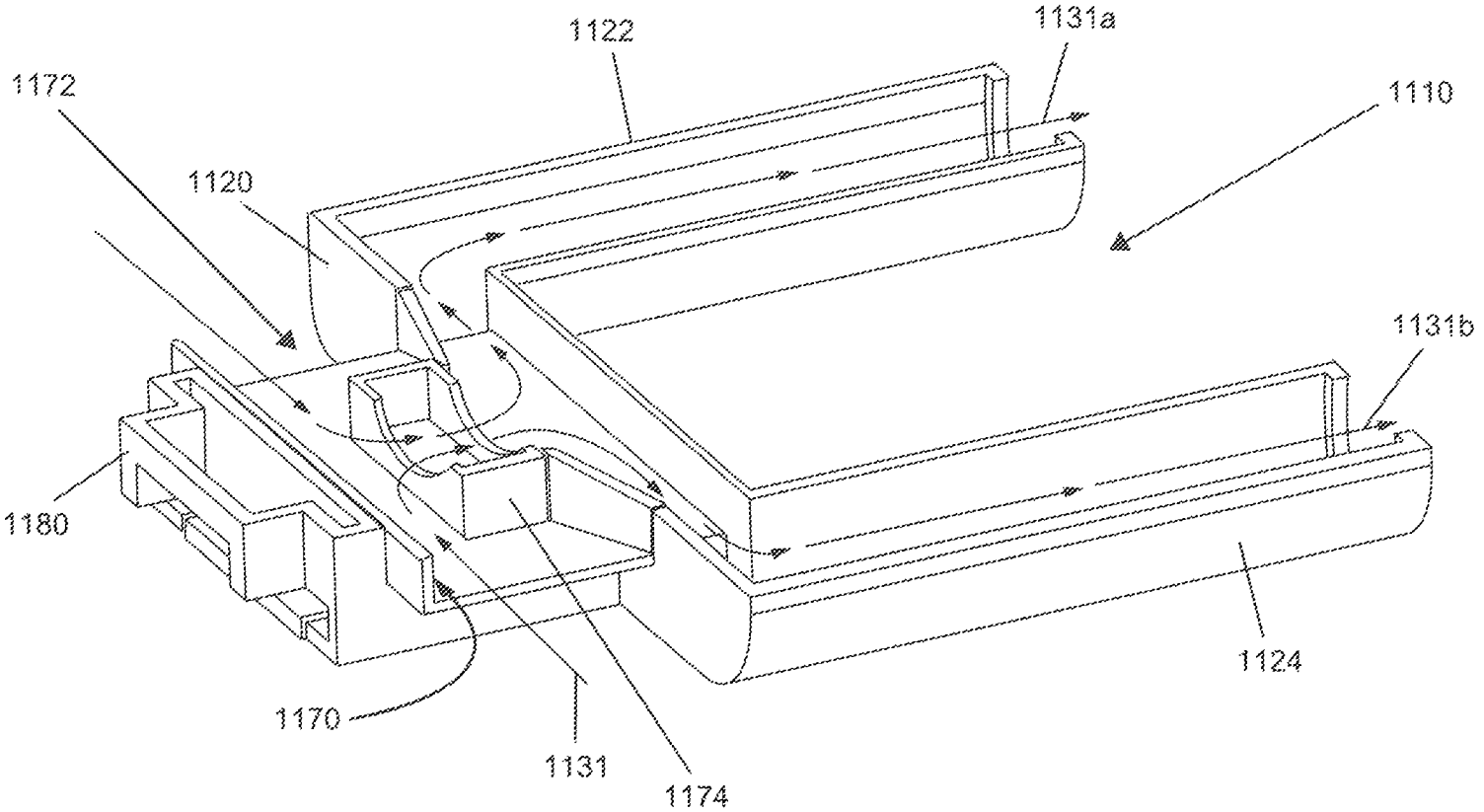
FIG. 13 is a perspective sectional view of the energy storage chamber of FIG. 7, taken along line 13-13 in FIG. 7, with a fan unit removed.

In the example shown, the post-motor filter 1080 is positioned rearward of the energy storage chamber 1100. The post-motor filter 1080 extends laterally across the rear of the suction motor 1050. The post-motor filter 1080 extends across substantially the entirety of the suction motor 1050 at the rear side 1104 of energy storage chamber 1100. As shown in FIG. 10, the perimeter of suction motor 1050 falls within the outer perimeter of the filter housing 1082 when viewed from the rear of hand vacuum cleaner 1000. The post-motor filter 1080 can filter air exiting the suction motor 1050 before it exits the hand vacuum cleaner 1100 via clean air outlet 1040.

As shown, the post-motor filter 1080 may also extend across the rear of lateral housing sections 1122 or 1124. This may allow the filter housing 1182 to support the energy storage chamber 1100 in the mounted position (e.g., an engagement member such as a protrusion provide on the energy storage chamber may be inter-engagable with (receivable in a recess of) the filter housing 1182). The filter housing 1182 may contact or be secured to the housing 1120 so as to prevent sagging of the rear of the energy storage chamber 1100.

As shown in FIG. 10, each of the energy storage members 1150 is positioned within the outer perimeter of the filter housing 1082 when viewed from the rear 1104 of hand vacuum cleaner 1000. That is, the central axis of each energy storage member 1150 extends through the volume defined by the perimeter of the post-motor filter 1080 when the energy storage chamber 1100 is mounted to main body 1010. It will be appreciated that, depending upon the size of the post-motor filter 1080 or the post-motor filter housing, the post-motor filter 1080 or the post-motor filter housing may not be positioned rearward of all of the suction motor or the energy storage members.

In the example illustrated, the energy storage chamber 1100 defines an open volume 1110 between the energy storage members 1150. The open volume 1110 is generally defined between the inner wall 1123 of the first lateral housing section 1122, the inner wall 1125 of the second lateral housing section 1124, and the base 1128 of the housing 1120. This open volume 1110 allows the battery pack 1100 to be mounted to the hand vacuum cleaner 1000 with one or more components of the hand vacuum cleaner, such as a motor or filter, nested between the energy storage members 1150.

In the example shown, the suction motor 1050 (and suction motor housing 1052) is positionable within the open volume 1110. The suction motor 1050 can laterally displaced from, and nested between, at least some of the energy storage members 1150 in the respective lateral sections 1122 and 1124. In the example shown, the suction motor 1050 may be positioned centrally between the energy storage members 1150 when the energy storage chamber 1100 is mounted on the main body 1010. The rotational axis 1054 of suction motor 1050 may be defined on a lateral plane that separates the upper and lower rows of energy storage members (i.e. a laterally extending central plane of the suction motor 1050 passes between energy storage members 1150*u* and 1150*l*).

Figure 7:
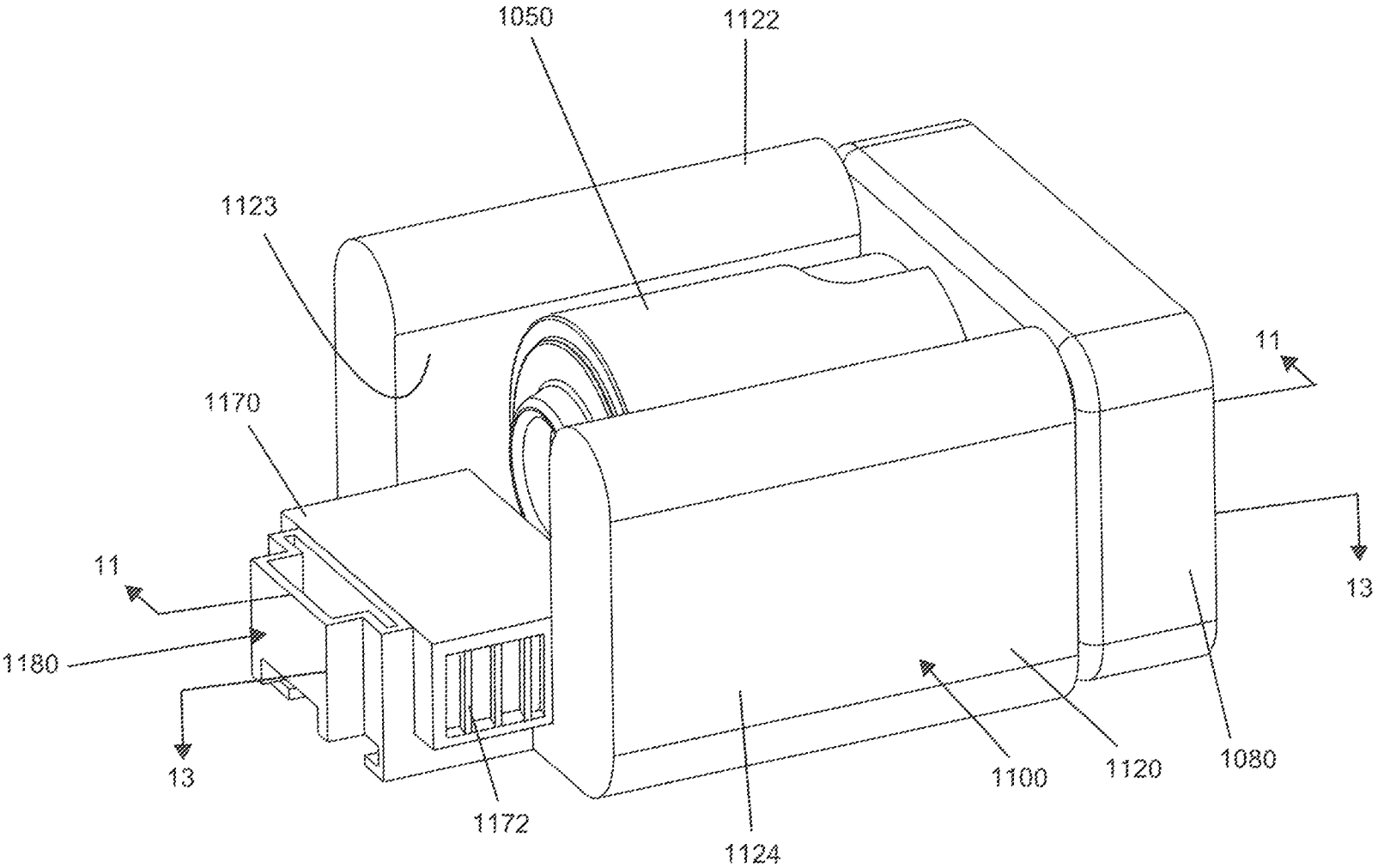
FIG. 7 is a front perspective isolation view of the energy storage chamber, suction motor and post-motor filter of the hand vacuum cleaner of FIG. 1 in accordance with an embodiment.

As shown, for example in FIG. 7, the entirety of suction motor 1050 can be positioned between the energy storage members 1150 (e.g. in open volume 1110). Alternatively, a portion of the suction motor 1050 may be external to the open volume 1110 (i.e. not located between the energy storage members 1150). For example, an upper portion of suction motor 1050 may be contained within the main body 1010 of the hand vacuum cleaner at a location above the upper end of the energy storage chamber 1100. Alternately, or in addition, a forward and/or a rearward portion of suction motor 1050 may be contained within the main body 1010 of the hand vacuum cleaner at a location forward and/or rearward of the energy storage chamber 1100

In alternative embodiments, the motor and fan assembly may not be nested within the energy storage chamber 1100. For example, the energy storage chamber 1100 may be positioned forward or rearward of the suction motor 1050 with at least a portion of a pre-motor filter 1090 or post-motor filter 1080 positioned between the energy storage members 1150.

Some energy storage members, such as lithium-ion batteries, may produce heat while being charged and/or discharged (e.g. while supplying power to an electric motor). Accordingly, it may be important to cool the energy storage members 1150, particularly where they are located near to other heat producing components of the hand vacuum cleaner 1000, such as suction motor 1050. The hand vacuum cleaner 1000 may direct air through the energy storage chamber 1100 (i.e. through the interior of housing 1120) to promote cooling of the energy storage members 1150.

In some embodiments, the hand vacuum cleaner 1000 can include a second air flow path 1131. The second airflow path 1131 may direct or enable a flow of ambient air towards (or through) the energy storage chamber 1100 containing the onboard energy storage members 1150. Ambient air is air other than that which is passing through the primary airflow path 1031, e.g., air drawn in from the exterior of the surface cleaning apparatus 1000. The ambient air drawn through the second air flow path can promote cooling of the energy storage members 1150.

The energy storage chamber 1100 may separate the batteries 1150 from the primary air flow path 1031. This may prevent dirt or debris entrained in the air in primary air flow path 1031 from dirtying the housing 1120 enclosing the energy storage chamber 1100. The housing 1120 of the energy storage chamber 1100 may also include a thermal barrier (e.g. a thermal insulating material) to prevent the suction motor 1050 or primary air flow path 1031 from heating the energy storage members 1150.

The housing 1120 of the energy storage chamber 1100 may include electrically insulating members that enclose the batteries 1150. For example, the housing 1120 itself may be manufactured of electrically insulating materials such as plastic. This may electrically insulate the batteries 1150 within the energy storage chamber 1100.

In some cases, at least a portion of the housing 1120 may be thermally conductive. For instance, having the outer sides of housing 1120 be thermally conductive permits heat transfer between the housing sections 1122 and 1124 of the energy storage chamber 1100 and ambient air outside the hand vacuum cleaner 1000. This may further promote cooling of the batteries 1150.

The second air flow path 1131 can pass through the housing sections 1122 and 1124 enclosing the energy storage members 1150. The energy storage chamber 1100 can include an ambient air inlet 1130. Ambient air can enter the second air flow path 1131 through ambient air inlet 1130.

Optionally, a filter may be positioned in the second airflow path 1131 upstream of the energy storage chamber 1100. For example, the filter may be positioned at the ambient air inlet 1130. The filter may prevent dirt and debris entrained in the ambient air from entering the second air flow path 1131 and/or energy storage chamber 1100 and potentially clogging air channels therethrough. The filter may be any suitable type of filter such as a foam filter, felt filter, HEPA filter, other physical filter media, electrostatic filter, and the like.

In the example shown, the energy storage chamber 1100 includes a fan unit 1170. The fan unit 1170 can include a fan 1174 operable to direct ambient air to flow through the second air flow path 1131. Ambient air can pass from the ambient air inlet 1130 and be drawn into the fan unit 1170 via fan inlet 1172. The ambient air can then pass through fan 1174, where the second air flow path 1131 splits into separate lateral airflow sections 1131*a* and 1131*b*. Air then passes through fan outlets 1178 to lateral housing sections 1122 and 1124, where the air may promote cooling of the energy storage members 1150. Air may then exit through a secondary air outlet or through clean air outlet 1040.

Providing the post-motor filter 1080 across at least a portion of the rear of the energy storage chamber 1100 may allow the post-motor filter 1080 to filter air through the secondary air flow path 1131 as well as the air flow path 1031. Air exiting the second air flow path 1031 may pass through the post-motor filter 1080 and exit the same clean air outlet 1040 as air from the primary air flow path 1031. If the energy storage chamber 1100 is removably mounted to the main body 1010, a gasket or the like may be provided to provide an airtight seal between the second airflow path 1131 and the post-motor filter 1080.

Referring to FIGS. 14-17, shown therein is an alternative example of an energy storage chamber 2100 and nesting arrangement for a hand vacuum cleaner, such as hand vacuum cleaner 1000. As exemplified in FIGS. 14-17, an energy storage chamber 2100 may allow part or all of a post-motor filter 2080 to be positioned between at least some of the energy storage members 2150. The features of energy storage chamber 2100 may be generally similar to the energy storage chamber 1100, with the reference numerals indicating similar features increased by 1000. Although a fan unit is omitted from energy storage chamber 2100, it will be appreciated that energy storage chamber 2100 may be provided with a fan unit analogous to fan unit 1174.

Figure 14:
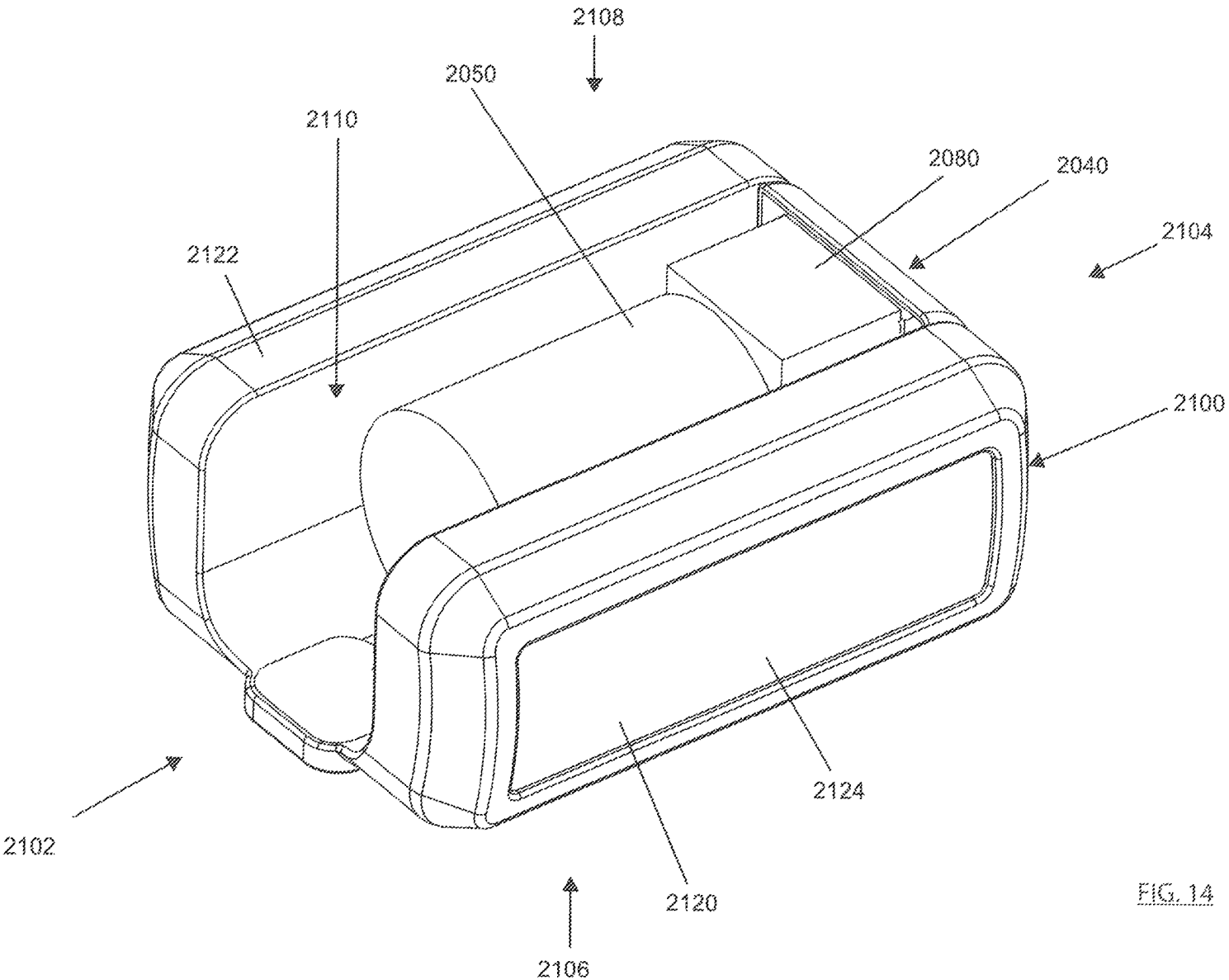
FIG. 14 is a top front perspective isolation view of an alternative energy storage chamber, suction motor, and post-motor filter in accordance with an embodiment.

As shown in FIG. 14, the energy storage chamber 1100 has a housing 2120 with a pair of opposed lateral side sections 2122 and 2124. A void or open volume 2110 is defined between the lateral housing sections 2122 and 2124. The volume 2110 may define a receiving or nesting space within which components of a hand vacuum cleaner can be positioned when the energy storage chamber 2100 is mounted thereto.

As with energy storage chamber 1100, the energy storage members 2150 are arranged into upper and lower rows within the lateral housing sections 2122 and 2124. In the energy storage chamber 2100, each row includes two energy storage members 2150 (upper energy storage members 2150*u* and lower energy storage members 2150*l*) that extend lengthwise along the energy storage chamber 2100 between the front 2102 and rear 2104.

In the example shown, a post-motor filter 2080 is positioned in the air flow path downstream from the suction motor 2050. The post-motor filter 2080 can filter air exiting the suction motor 2050 before the air exits the vacuum cleaner via clean air outlet 2040. The rotational axis of the suction motor 2050 can pass through the outer perimeter of the post-motor filter 2080. This may reduce the number of air flow directions, and thus reduce backpressure and/or air flow losses through this portion of the hand vacuum cleaner.

Figure 15:
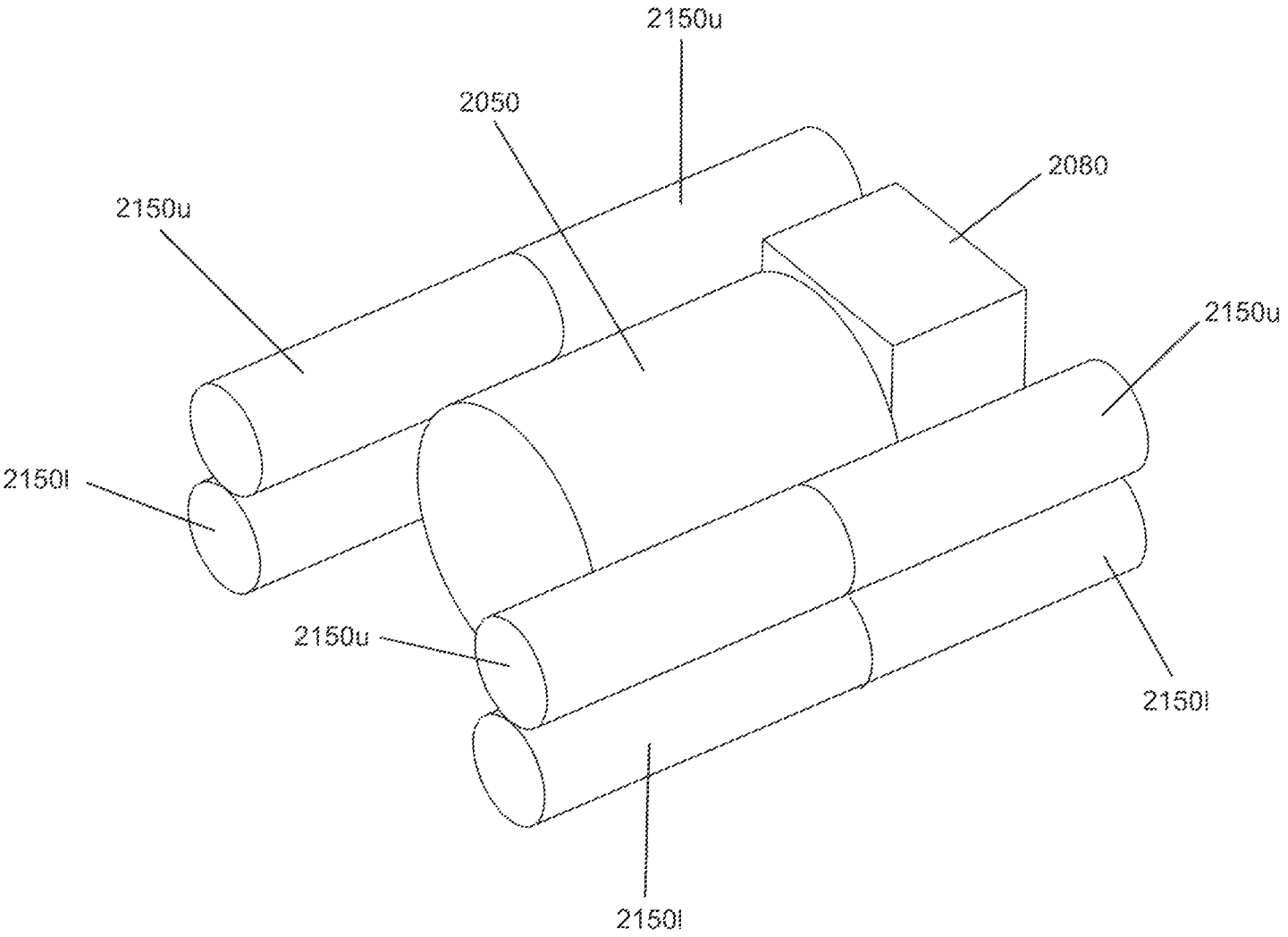
FIG. 15 is a top front perspective isolation view of the energy storage chamber, suction motor, and post-motor filter of FIG. 14 with a housing of the energy storage chamber and suction motor removed.
Figure 16:
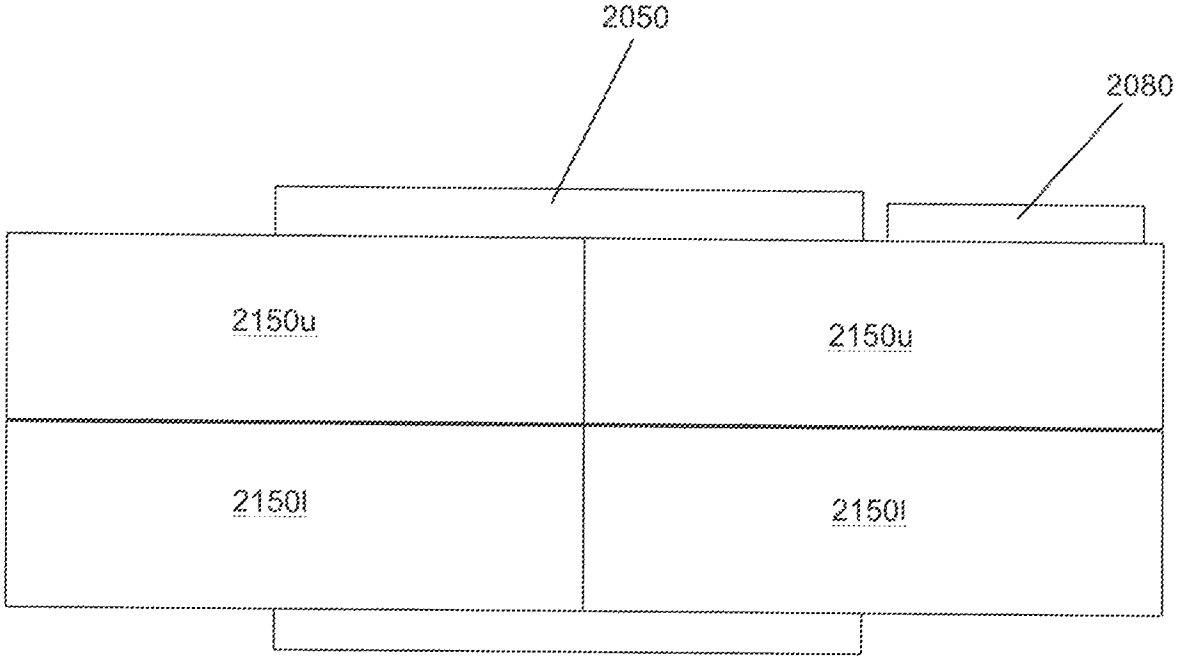
FIG. 16 is a side view of the energy storage chamber, suction motor, and post-motor filter of FIG. 15.
Figure 17:
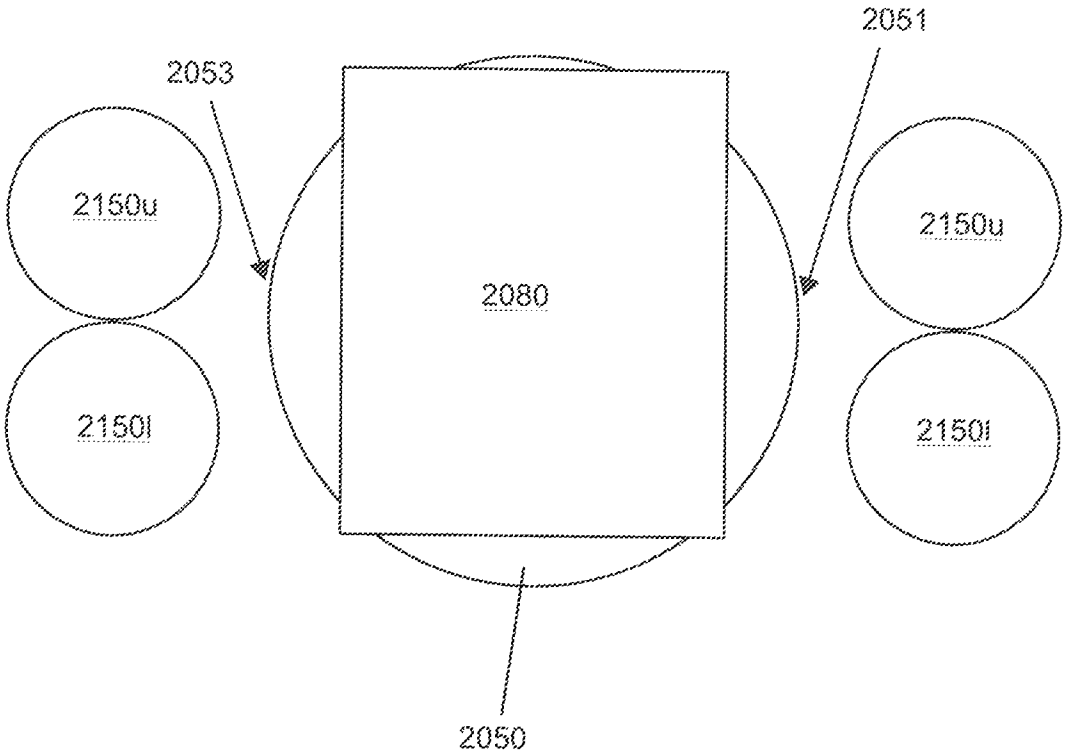
FIG. 17 is a rear view of the energy storage chamber, suction motor, and post-motor filter of FIG. 15.

As exemplified in FIG. 15, when the energy storage chamber 2100 is mounted on the hand vacuum cleaner, all of the post-motor filter 2080 is positioned between the energy storage members 2150. As exemplified, the post-motor filter 2080 is positioned between the rear energy storage members 2150 of both the upper and lower rows.

As shown, the post-motor filter 2080 can be sized to fit entirely within the open volume 2110 of the energy storage chamber 2100. Alternatively, a portion of the post-motor filter 2080 may extend outside of the open volume 2110, for instance above the upper end of the energy storage chamber 2100 and/or rearward of the energy storage members.

The suction motor 2050 can also be positioned between the energy storage members 2150 of energy storage chamber 2100. As shown in FIG. 14, the suction motor 2050 also nests within the open volume 2110. This may provide a compact nesting arrangement for the batteries, suction motor 2050 and post-motor filter 2080, while also ensuring substantially linear air flow between suction motor 2050 and post-motor filter 2080. As shown, a portion of both the forward and rearward energy storage members 2150 in the upper and lower rows can be positioned on both lateral sides 2051 and 2053 of the suction motor 2050. The suction motor 2050 can be laterally adjacent to a portion of each of the energy storage members 2150 in the energy storage chamber 2100.

A portion of the open volume 2110 is located forward of the suction motor 2050. This may allow the energy storage chamber 2100 to nest with other components of the hand vacuum cleaner, such as a pre-motor filter. Additionally or alternatively, a fan unit may be positioned within this empty region of open volume 2110.

Figure 18:
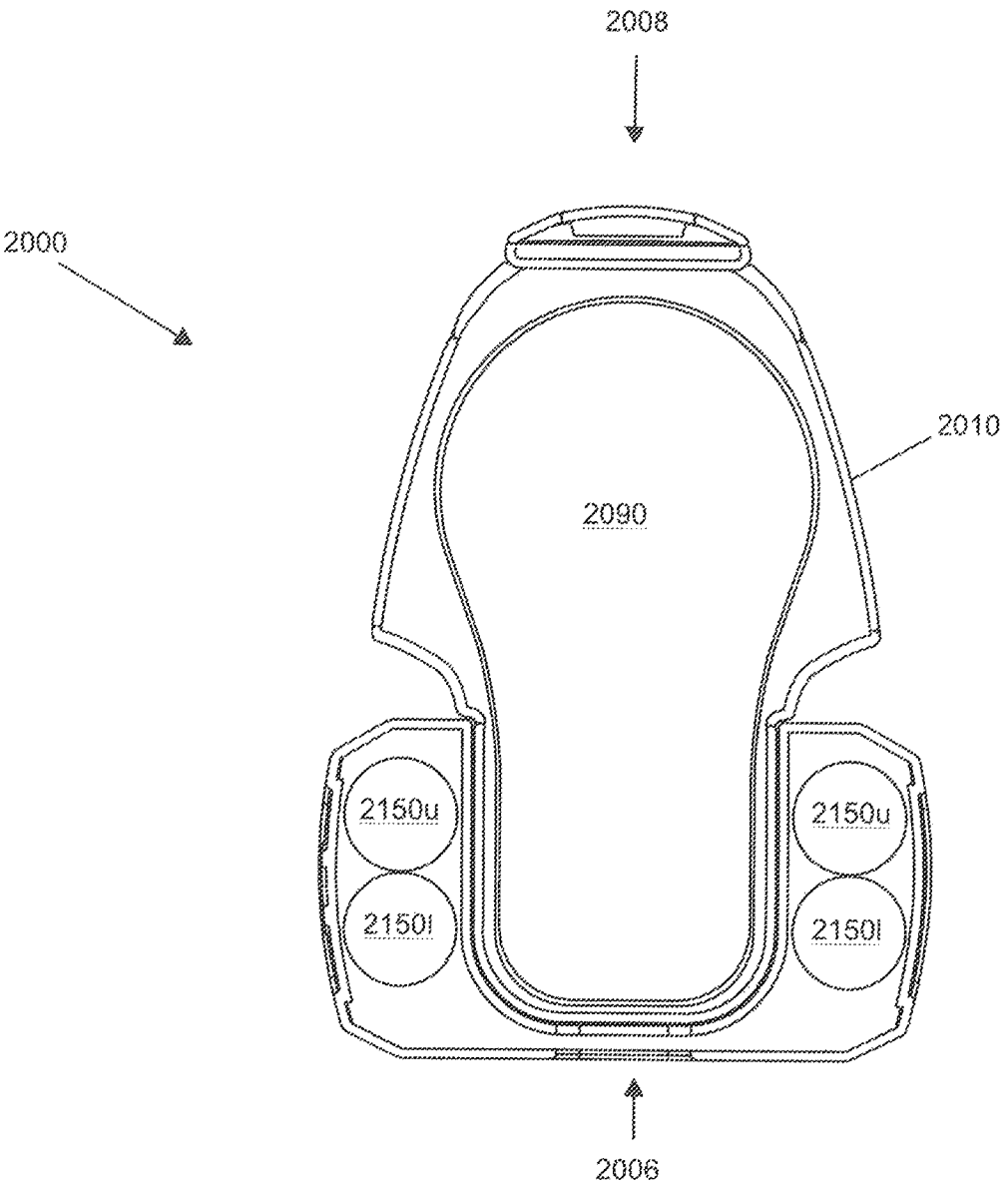
FIG. 18 is a section view of an alternative hand vacuum cleaner in accordance with an embodiment.
Figure 19:
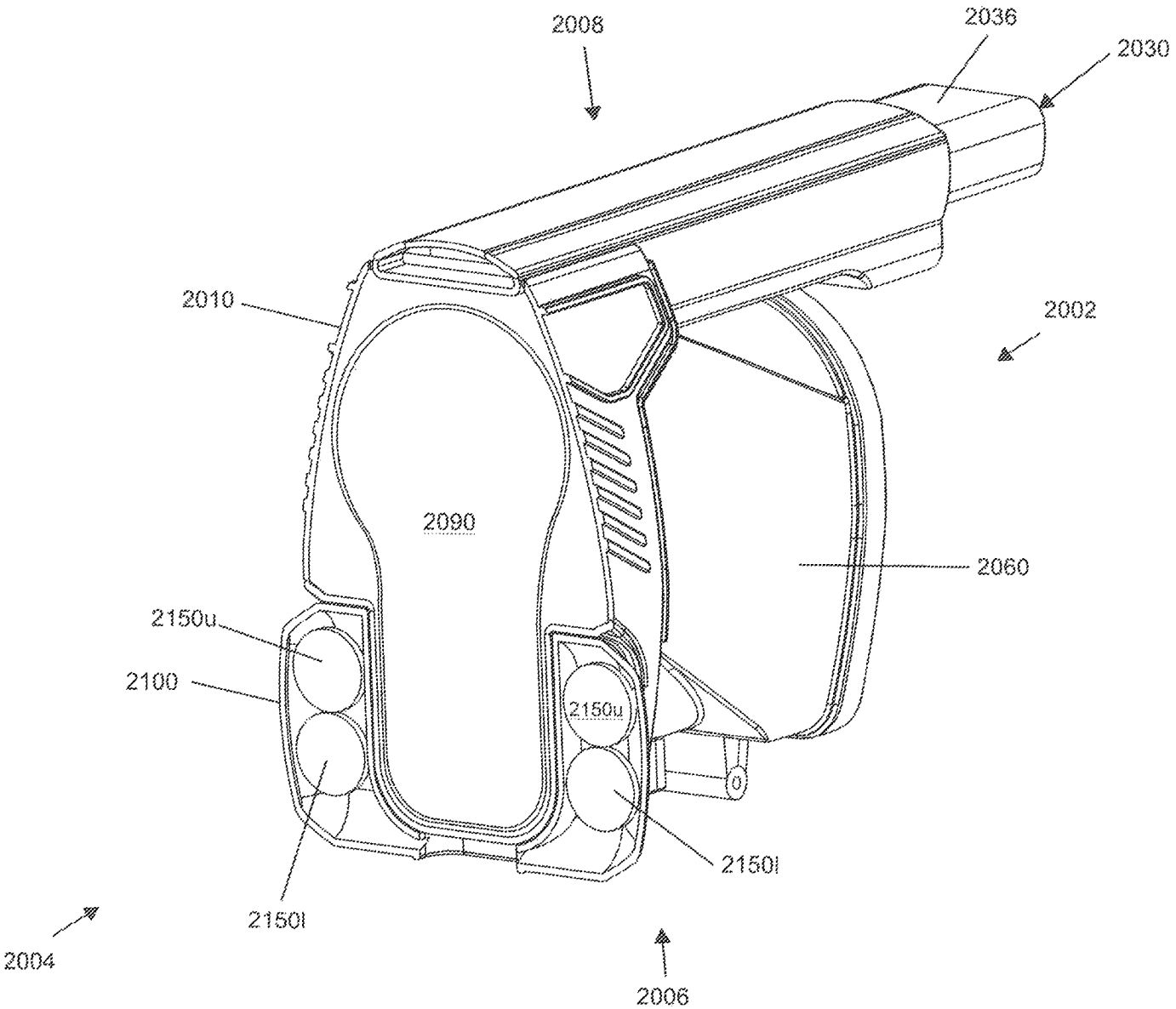
FIG. 19 is a rear perspective sectional view of the hand vacuum cleaner of FIG. 18.

As shown in FIGS. 18 and 19, the energy storage chamber 2100 may be used with an alternative hand vacuum cleaner 2000. The hand vacuum cleaner 2000 can include a pre-motor filter 2090 that nests at least partially between the energy storage members 2150 of the energy storage chamber 2100. As shown, the pre-motor filter 2090 extends downward into the forward portion of the open volume 2110 (e.g., the forward portion that is vacant in FIG. 15). This lower portion of the pre-motor filter 2090 can thus be positioned between the front energy storage members 2150 when the energy storage chamber 2100 is mounted to the hand vacuum cleaner 2000.

Nesting the pre-motor filter 2090 between the energy storage members 2150 may allow the hand vacuum cleaner to provide a substantially linear air flow between the outlet of the pre-motor filter 2090, the suction motor 2050, and the post-motor filter 2080. In the example illustrated, the rotational axis of the suction motor 2050 extends through a portion of the pre-motor filter 2090 and through a portion of the post-motor filter 2080. Air can travel through this section of the hand vacuum cleaner 2000 with minimal changes in direction, which may backpressure and/or air flow losses.

Figure 20:
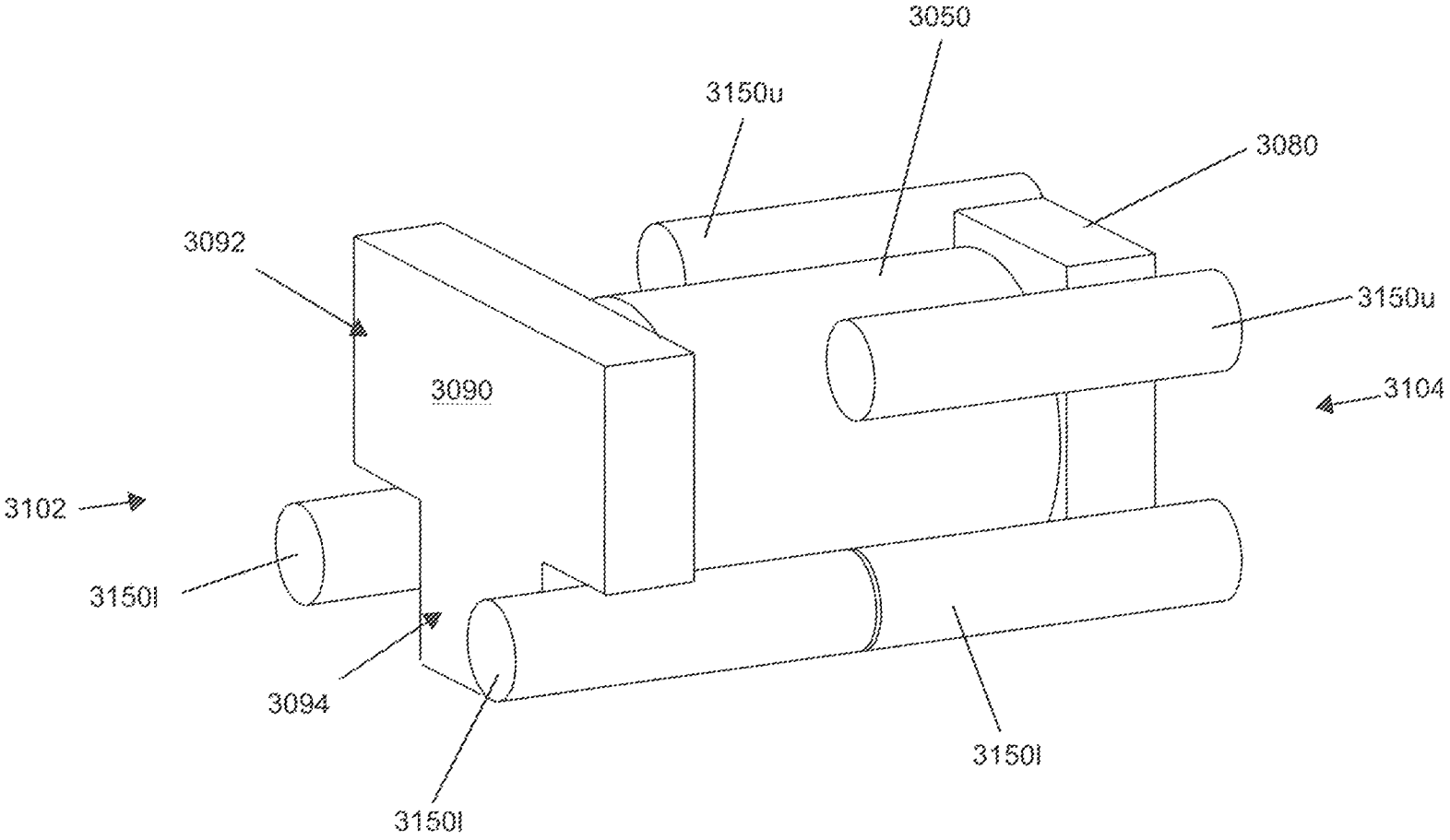
FIG. 20 is a top front perspective isolation view of an energy storage chamber, suction motor, pre-motor filter and post-motor filter that may be used with the vacuum cleaner of FIG. 18 with a housing of the energy storage chamber and suction motor removed.
Figure 21:
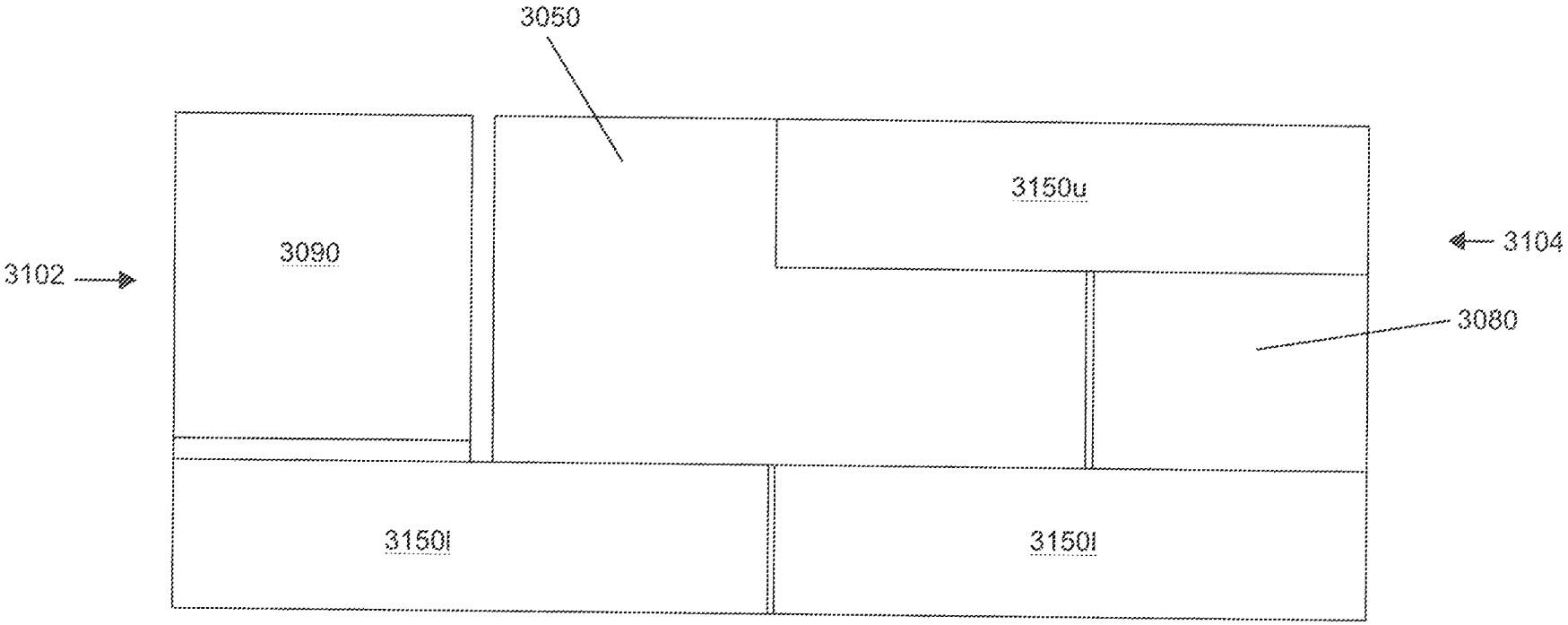
FIG. 21 is a side view of the energy storage chamber, suction motor, pre-motor filter and post-motor filter of FIG. 20.
Figure 22:
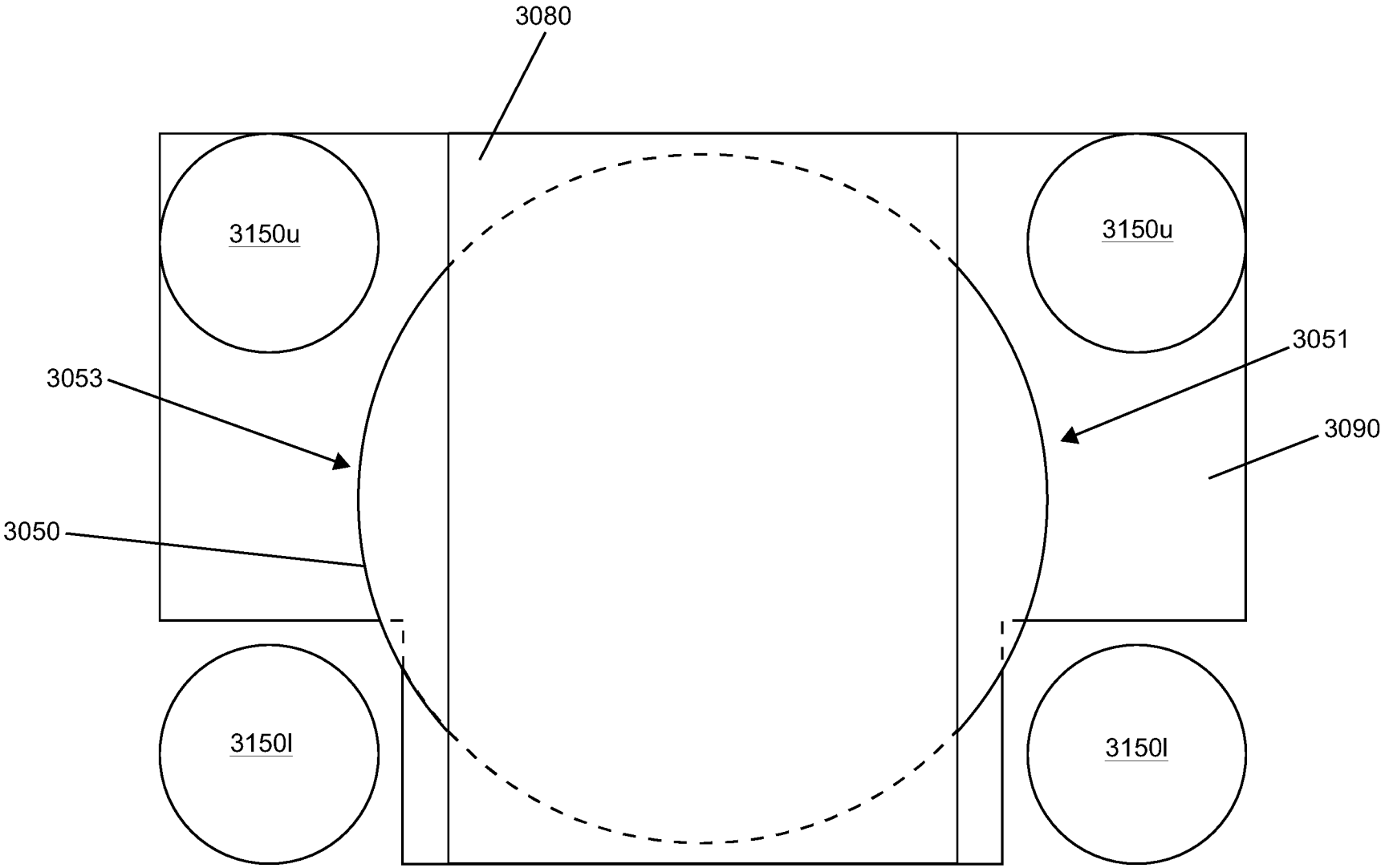
FIG. 22 is a rear view of the energy storage chamber, suction motor, pre-motor filter and post-motor filter of FIG. 20.

Referring to FIGS. 20-22, shown therein is an alternative example of a nesting arrangement for a hand vacuum cleaner, such as hand vacuum cleaners 1000 and 2000. As shown, energy storage members 3150 are arranged into two rows, upper energy storage members **3150*u* and lower energy storage members 3150*l*. As with energy storage chambers 1100 and 2100, the energy storage members 3150** can be contained within lateral housing sections of the energy storage chamber.

As with energy storage chamber 2100, the suction motor 3050 and post-motor filter 3080 can be positioned between the energy storage members 3150. Energy storage members **3150*u* and 3150*l* are positioned on both lateral sides 3051 and 3053 of the suction motor 3050. A portion of a pre-motor filter 3090 can also be positioned between the energy storage members 3150. The rotational axis of the suction motor 3050 passes through both the pre-motor filter 3090 and post-motor filter 3080**, allowing for substantially linear air flow in this section of the vacuum cleaner.

However, unlike the energy storage chambers 1100 and 2100, the rows of energy storage members 3150 have different lengths. As shown, the upper row of energy storage members **3150*u* includes fewer energy storage members, in this case only one energy storage member in each upper row, as compared to two energy storage members 3150*l* in the lower rows. This allows components of the hand vacuum cleaner to nest above (i.e., to overlie) the batteries 3150*l* in the lower row at the front 3102 of the energy storage chamber—in front of the upper batteries 3150*u* that are positioned at the rear 3104**.

In the example illustrated, the pre-motor filter 3090 has a first portion 3092 and a second portion 3094. The first, or upper portion, 3092 has a wider lateral extent, with an axis of the upper energy storage members **3150*u* extending through the upper portion 3092. The upper portion 3092 can overlie a portion of the lower energy storage members 3150*l* that are positioned at the front of the energy storage chamber. The lower portion 3094 has a narrower lateral width and is positioned between the front lower energy storage members 3150*l***.

Accordingly, by varying the length of one or more rows of the energy storage members (e.g., using more or fewer batteries), an open volume of different shapes may be provided which can be used to accommodate more or less of a filter and/or the suction motor. Preferably, the same number of batteries are provided on each lateral side so as to provide a more uniform weight distribution on either side of a central plane extending longitudinally (front to back) through the hand vacuum cleaner.

Figure 23:
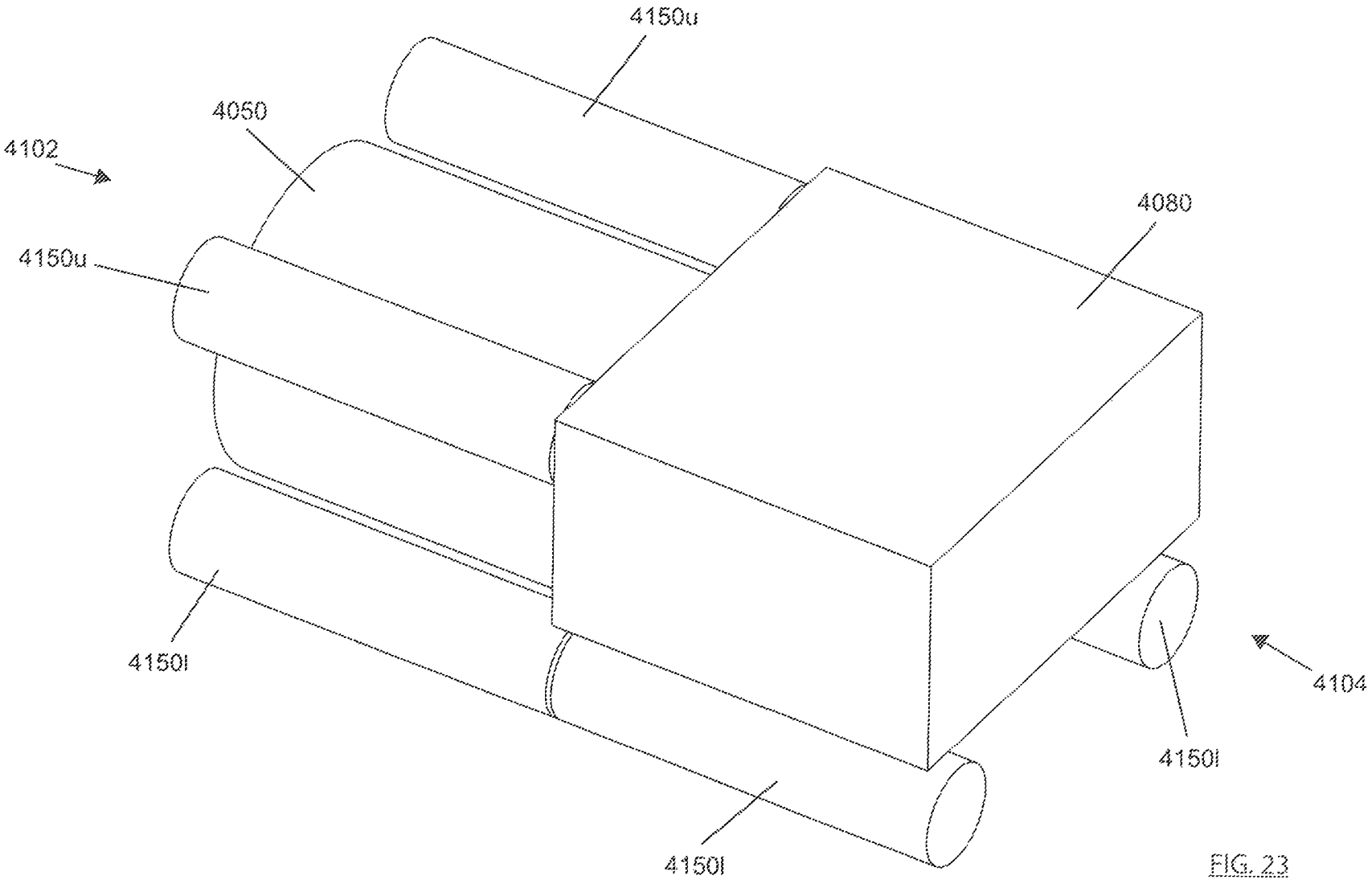
FIG. 23 is a rear perspective isolation view of an alternative energy storage chamber, suction motor and post-motor filter that may be used with the hand vacuum cleaner of FIG. 1 or FIG. 18 in accordance with an embodiment with a housing of the energy storage chamber and the suction motor removed.
Figure 24:
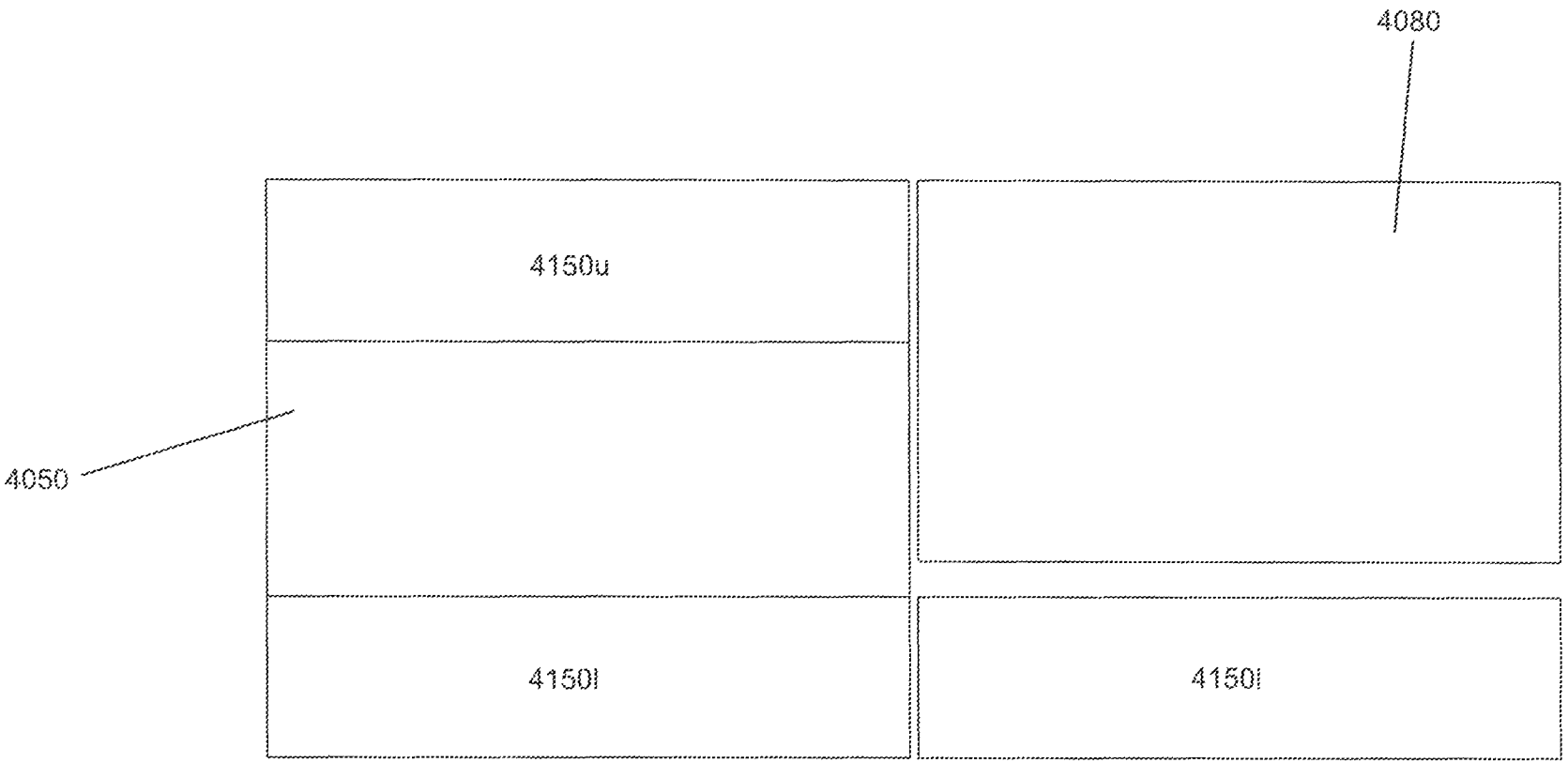
FIG. 24 is a side view of the energy storage chamber, suction motor and post-motor filter of FIG. 23.
Figure 25:
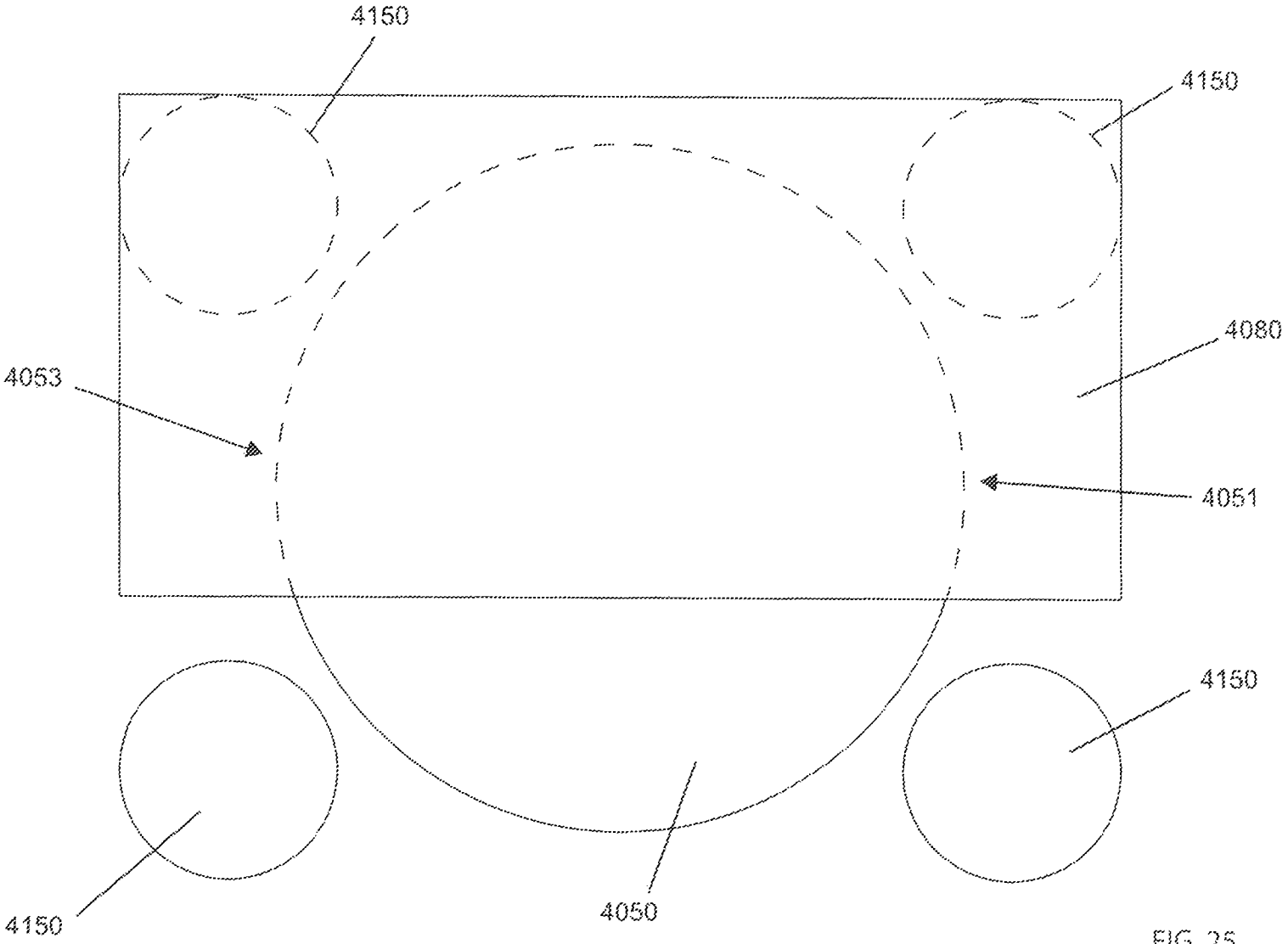
FIG. 25 is a rear view of the energy storage chamber, suction motor and post-motor filter of FIG. 23.

Referring to FIGS. 23-25, shown therein is an alternative example of a nesting arrangement for a hand vacuum cleaner, such as hand vacuum cleaners 1000 and 2000. As with the example shown in FIGS. 20-22, energy storage members 4150 are arranged into upper and lower rows, extending axially between the front 4102 and rear 4104 of the energy storage chamber. As shown, the lower energy storage members **4150*l* extend along a greater axial extent than the upper energy storage members 4150*u*. However, in this example the lower row of energy storage members 4150*l* extends rearward of the upper row of energy storage members 4150*u* (i.e. there are no upper energy storage members 4150*u* at the rear 4104 of the energy storage chamber). As with energy storage chambers 1100 and 2100, the energy storage members 4150** can be contained within lateral housing sections of the energy storage chamber.

As shown, the post-motor filter 4080 can overlie the rear lower energy storage members 4150. The post-motor filter 4080 can also extend across the longitudinal axis of the upper energy storage members **4150*u*** on either lateral side.

The suction motor 4050 can be positioned centrally between the upper energy storage members **4150*u* and lower energy storage members 41501 at the front 4102. Energy storage members 4150*u* and 41501 are positioned on both lateral sides 4051 and 4053 of the suction motor 4050. The rotational axis of the suction motor 4050 can extend through the post-motor filter 4080**, allowing for substantially linear air flow towards the clean air outlet.

Figure 26:
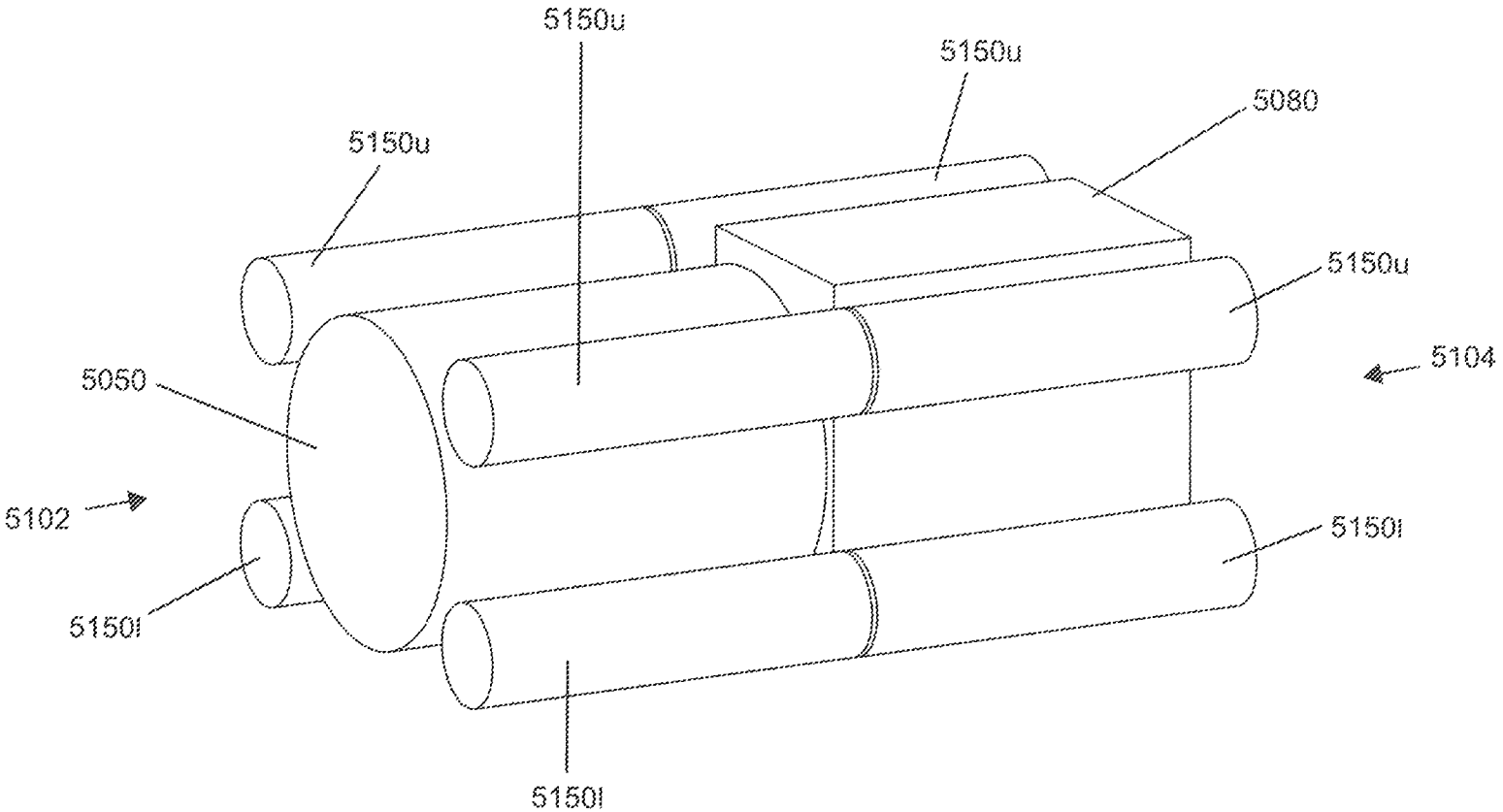
FIG. 26 is a front perspective isolation view of another alternative energy storage chamber, suction motor and post-motor filter that may be used with the hand vacuum cleaner of FIG. 1 or FIG. 18 in accordance with an embodiment with a housing of the energy storage chamber and suction motor removed.
Figure 27:
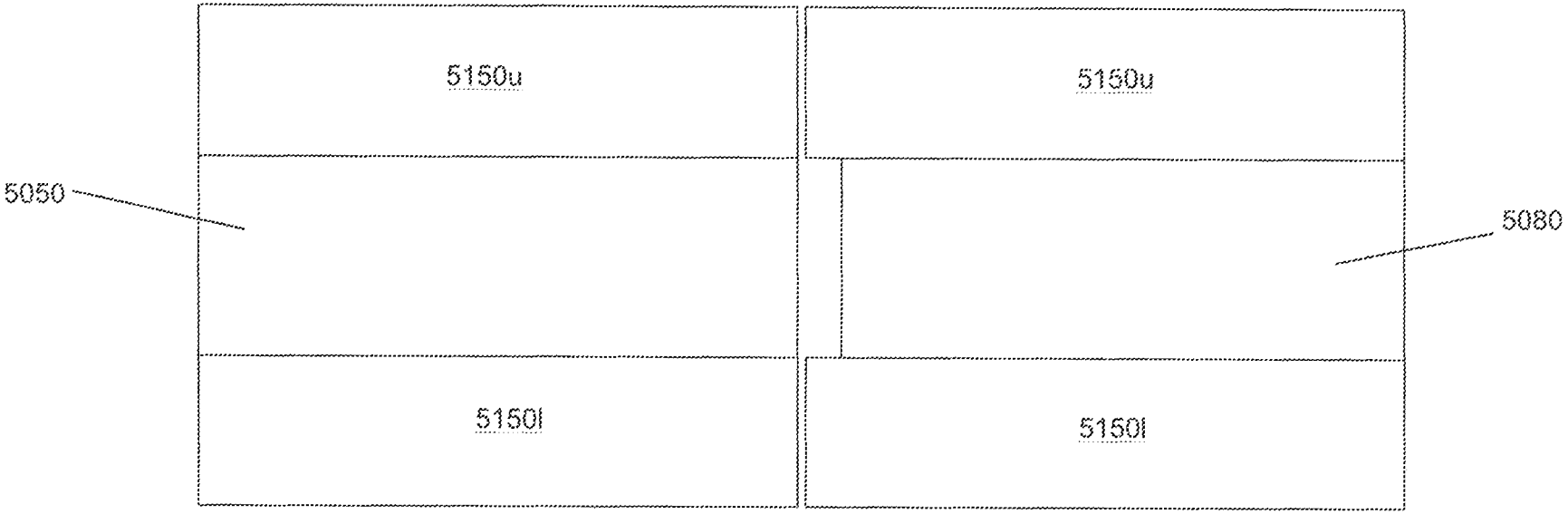
FIG. 27 is a side view of the energy storage chamber, suction motor and post-motor filter of FIG. 26.
Figure 28:
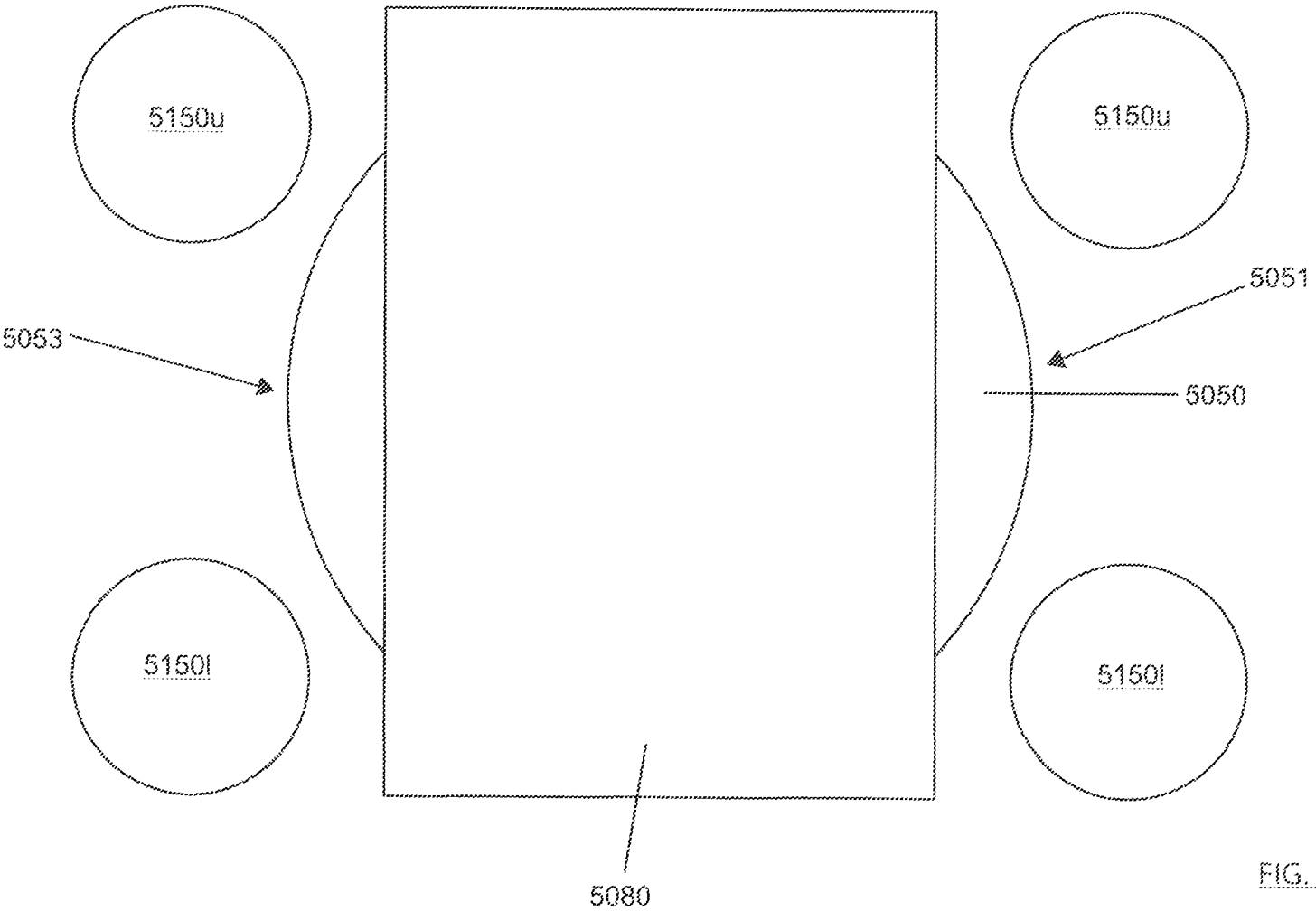
FIG. 28 is a rear view of the energy storage chamber, suction motor and post-motor filter of FIG. 26.
Figure 29:
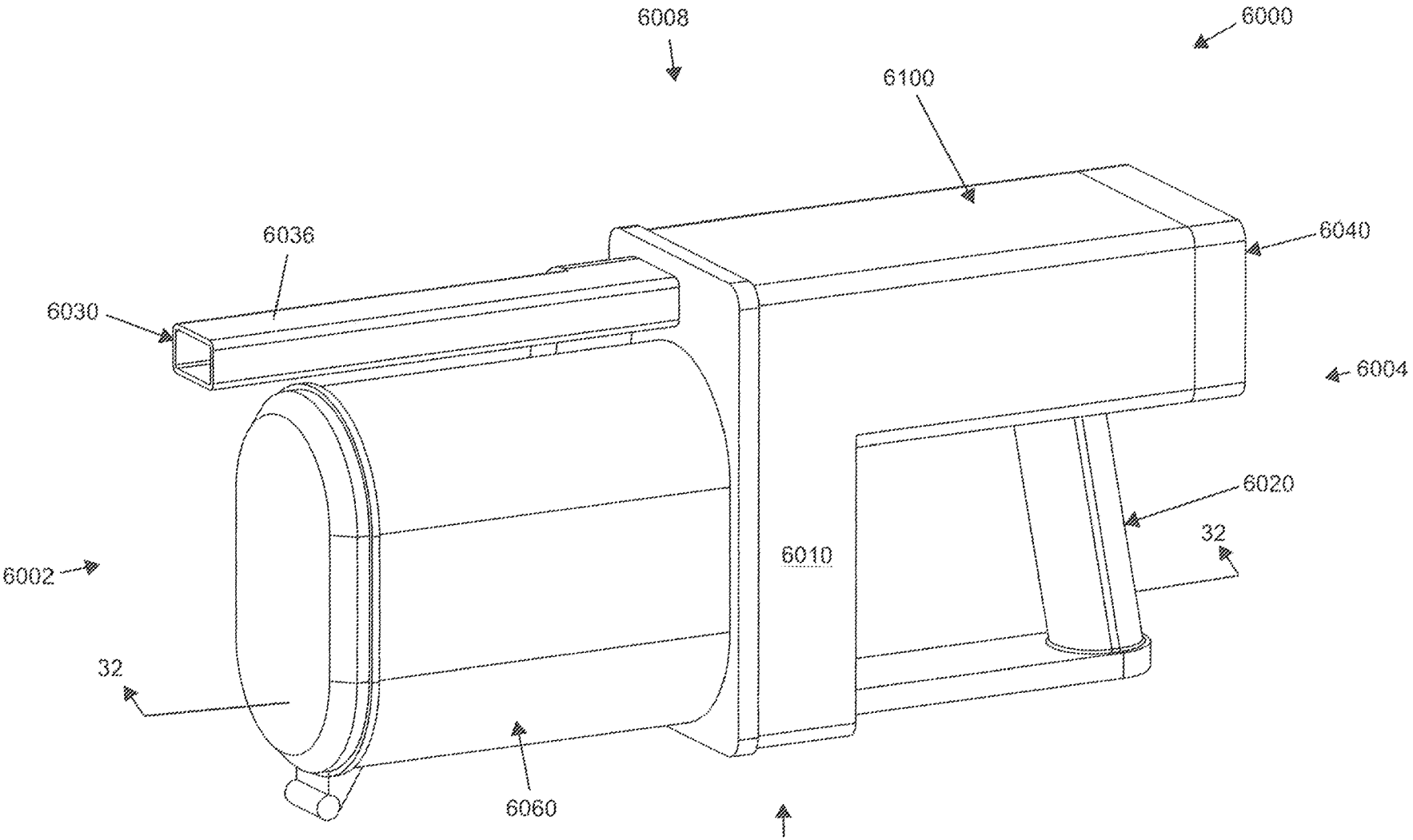
FIG. 29 is a top front perspective view of an alternative hand vacuum cleaner in accordance with an embodiment.

Referring to FIGS. 26-28, shown therein is an alternative example of a nesting arrangement for a hand vacuum cleaner, such as hand vacuum cleaners 1000 and 2000. In the example shown in FIGS. 26-28, the energy storage members 5150 are arranged into upper and lower rows, extending axially between the front 4102 and rear 4104 of the energy storage chamber. As shown, the upper and lower rows having the same length, similar to energy storage chambers 1100 and 2100. However, in the example shown here, the suction motor 5050 extends along the entire length of the energy storage members 5150*u* and 5150*l* at the front 5102 of the energy storage chamber.

Energy storage members 5150*u* and 51501 are positioned on both lateral sides 5051 and 5053 of the suction motor 5050. The post-motor filter 5080 is nested between the energy storage members 5150 at the rear 5104 of the energy storage chamber. As with energy storage chambers 1100 and 2100, the energy storage members 5150 can be contained within lateral housing sections of the energy storage chamber.

Referring to FIGS. 29-32, shown therein is an alternative example of a hand vacuum cleaner 6000. The hand vacuum cleaner 6000 is an example of a hand vacuum cleaner in which the energy storage chamber 6100 is mounted to the upper portion of the main body 6110. The features of hand vacuum cleaner 6000 similar to those of hand vacuum cleaner 1000 are identified using reference numerals incremented by 5000.

As with hand vacuum cleaner 1000, the hand vacuum cleaner 6000 includes a main body 6010 having a housing, a handle 6020, an air treatment member 6060 connected to the main body 6010, a dirty air inlet 6030, a clean air outlet 6040, and an air flow path 6031 extending between the dirty air inlet 6030 and the clean air outlet 6040, which may be referred to as a first or primary air flow path. However, in hand vacuum cleaner 6000, the clean air outlet 6040 is positioned at the upper rear of the main body 6010.

Surface cleaning apparatus 6000 has a front end 6002, a rear end 6004, an upper end or top 6006, and a lower end or bottom 6008. A motor and fan assembly is provided to generate vacuum suction through the first air flow path 6031. In the example shown, the motor and fan assembly is a suction motor 6050.

As with hand vacuum cleaner 1000, the air treatment member 6060 may be any air treatment member and is exemplified as a cyclone assembly having a single cyclonic cleaning stage with a single cyclone chamber 6062. In the example shown, a dirt collection region 6064 in included that is external to the cyclone chamber 6062.

Figure 30:
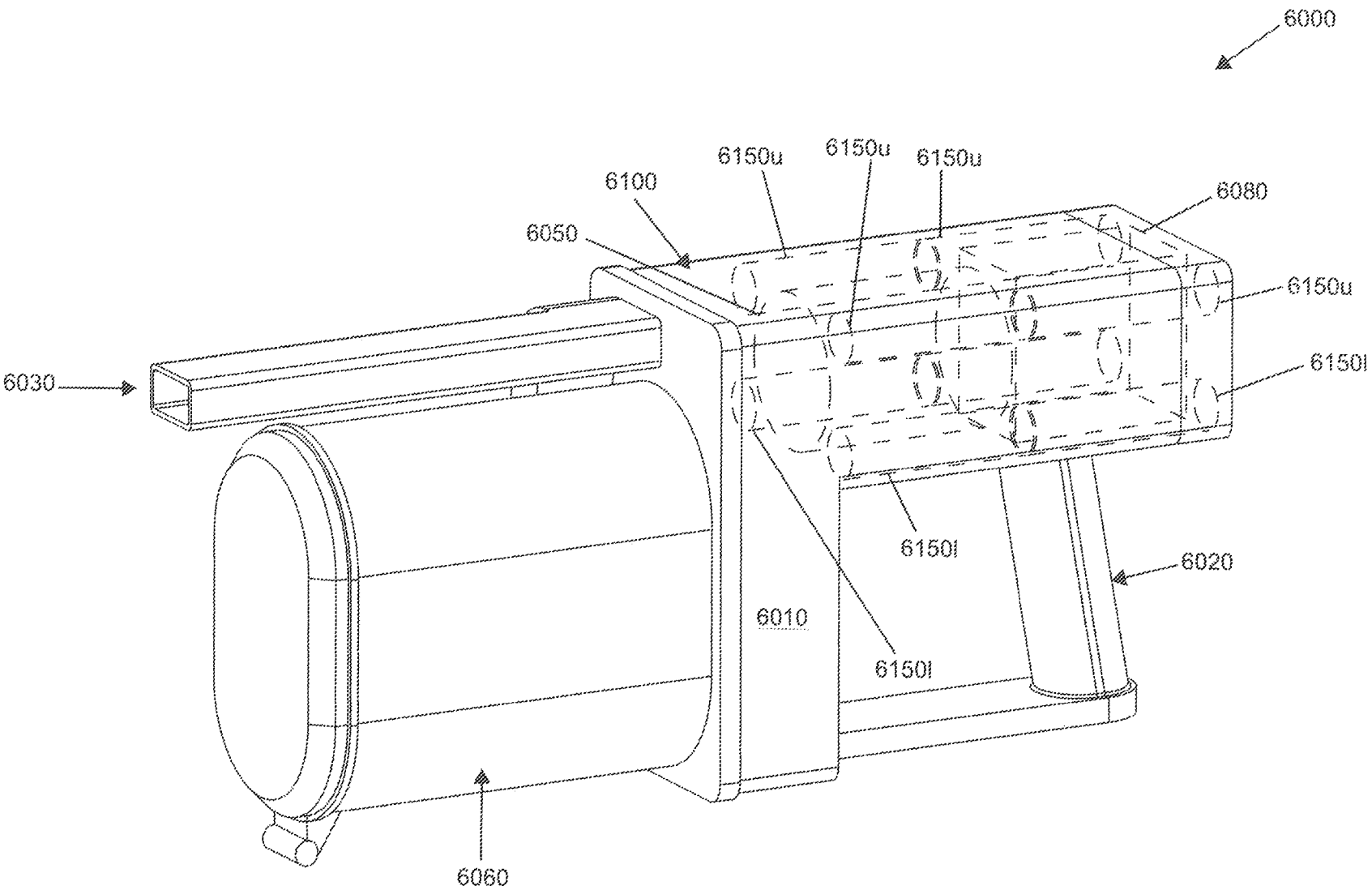
FIG. 30 is a top front perspective view of the hand vacuum cleaner of FIG. 29 showing the internal position of the energy storage chamber, suction motor and post-motor filter in accordance with an embodiment.
Figure 31:
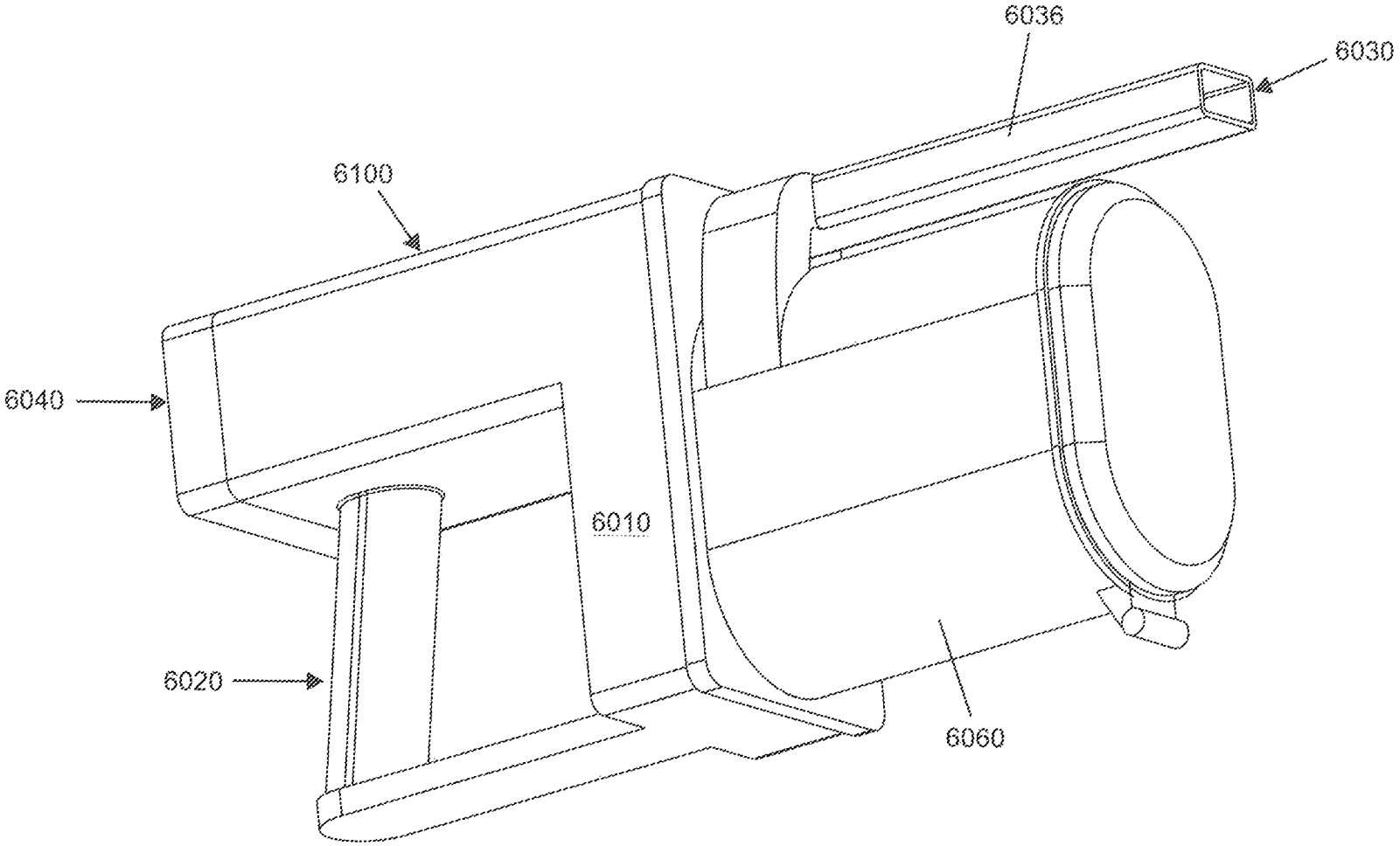
FIG. 31 is a bottom front perspective view of the hand vacuum cleaner of FIG. 29; and, FIG. 32 is a cross-sectional view of the hand vacuum cleaner of FIG. 29 along line 32-32 in FIG. 29.
Figure 32:
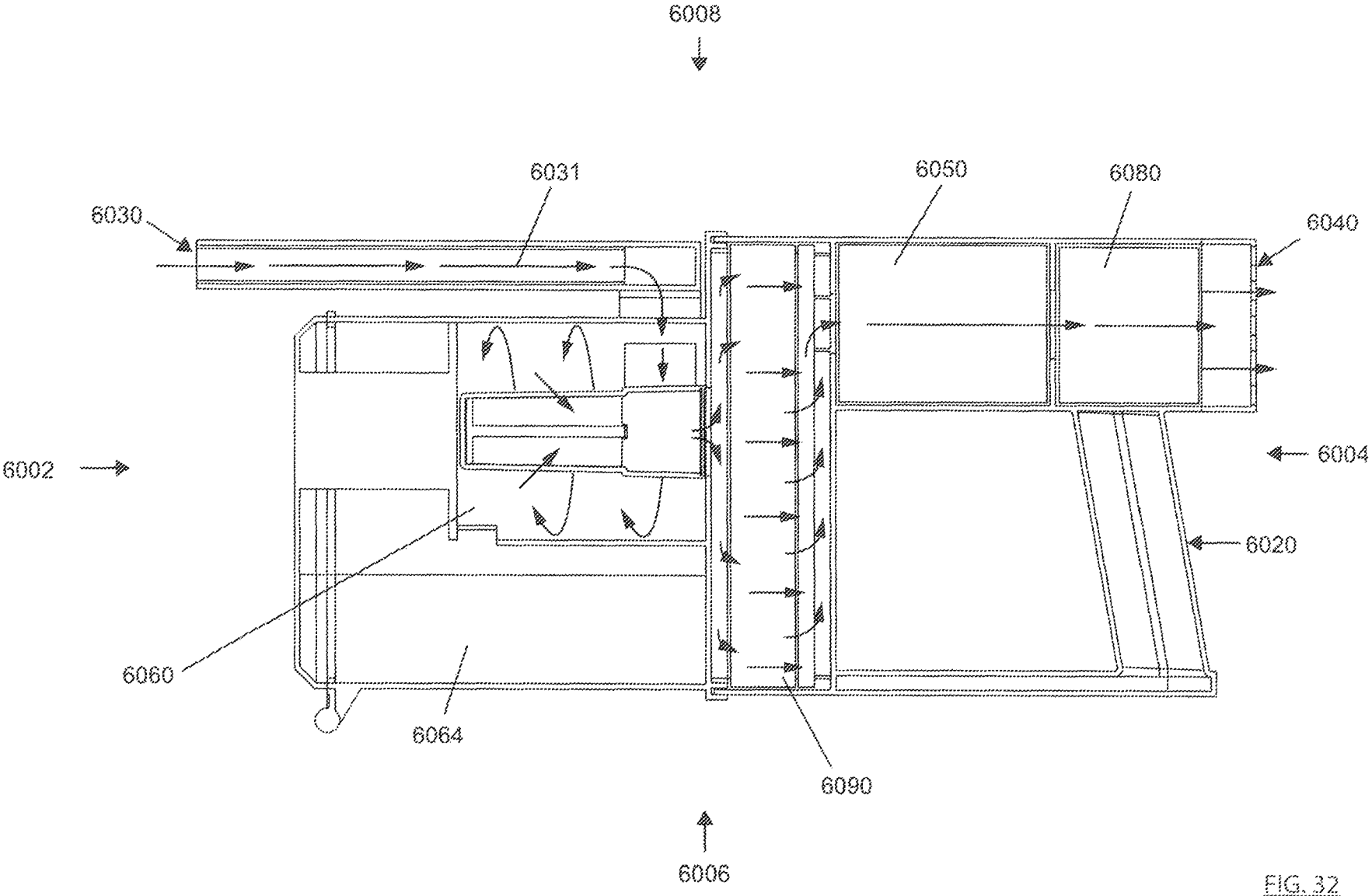

The handle 6020 is located at the rear end 6004 of the hand vacuum cleaner 6004. The handle 6020 has a handle axis extending between upper and lower ends of the handle. As shown in FIG. 30, a plurality of batteries 6150 are positioned at the upper end of the handle 6020.

Hand vacuum cleaner 6000 can include an energy storage chamber 6100 that is arranged to allow components of the hand vacuum cleaner 6000 to nest between the plurality of energy storage members 6150. In the example shown, the energy storage chamber 6100 has the motor and fan assembly 6050 and the post-motor filter 6080 nested between energy storage members 6150 at the upper end of the handle 6020. The configuration of the energy storage members 6150 in energy storage chamber 6100 is generally similar to that shown in FIGS. 26-28. In alternative embodiments, the various nesting arrangements and energy storage chambers shown in FIGS. 6-28 may be used in hand vacuum cleaner 6000 with suitable modifications (e.g. flipping the locations of components vertically) to allow for the positioning of the energy storage chamber 6000 on the upper end of the main body 6010. The energy storage chamber 6100 may also be upwardly removable using any means disclosed herein.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hand vacuum cleaner having a front end, a rear end, an upper end and a lower end, the hand vacuum cleaner comprising:

(a) an air flow path from an air inlet with an air treatment member and a fan and motor assembly in the air flow path, the motor and fan assembly having a motor axis of rotation and the air treatment member having an air treatment member axis extending between the front and rear end of the hand vacuum cleaner wherein the air treatment member axis and the motor axis of rotation are generally parallel;

(b) a handle having a hand grip portion; and, (c) a plurality of energy storage members wherein the plurality of energy storage members are located in a removable housing that forms a portion of an exterior surface of the hand vacuum cleaner, wherein the removable housing is removable while the fan and motor assembly remains in position in the hand vacuum cleaner and wherein the motor and fan assembly has first and second lateral sides which are spaced apart in a lateral direction on opposite sides of the axis of rotation, wherein at least a first axially extending row of the energy storage members is provided on the first lateral side of the motor and fan assembly and at least a second axially extending row of the energy storage members is provided on the second lateral side of the motor and fan assembly, wherein at least the first axial extending row of energy storage members comprises two energy storage members wherein a first energy storage member is positioned axially rearward of a second energy storage member.

2. The hand vacuum cleaner of claim 1 wherein the handle is located at the rear end of the hand vacuum cleaner, the handle has a handle axis extending between upper and lower ends of the handle and the plurality of energy storage members and the motor and fan assembly are positioned at the lower end of the handle.

3. The hand vacuum cleaner of claim 1 wherein the handle is located at the rear end of the hand vacuum cleaner, the handle has a handle axis extending between upper and lower ends of the handle and the plurality of energy storage members and the motor and fan assembly are positioned at the upper end of the handle.

4. The hand vacuum cleaner of claim 1 wherein an open volume is provided between at least some of the energy storage members and at least a portion of a filter is located in the open volume.

5. The hand vacuum cleaner of claim 1 wherein the removable housing has first and second lateral sides which are spaced apart in a lateral direction on opposite sides of the motor axis of rotation and the removable housing is U-shaped with each of the first and second lateral sides of the removable housing having an axially extending lateral side portion which contains some of the plurality of energy storage members.

6. The hand vacuum cleaner of claim 5 wherein the removable housing further comprises a base portion that extends between the lateral side portions and the base portion has an absence of energy storage members.

7. The hand vacuum cleaner of claim 1 wherein the handle comprises a pistol grip handle having a lower end, the housing is removably mountable at the lower end of the handle and a lower end of the motor and fan assembly is provided at the lower end of the hand vacuum cleaner.

8. The hand vacuum cleaner of claim 7 wherein the housing is removable in a downward direction.

9. A hand vacuum cleaner having a front end, a rear end, an upper end and a lower end, the hand vacuum cleaner comprising:

(a) an air flow path from an air inlet with an air treatment member and a fan and motor assembly in the air flow path, the motor and fan assembly having a motor axis of rotation;

(b) a hand vacuum cleaner body;

(c) a handle having a hand grip portion; and, (d) a plurality of energy storage members are located in a removable housing that forms a portion of an exterior surface of the hand vacuum cleaner, wherein the removable housing is removable while the fan and motor assembly remains in position in the hand vacuum cleaner, wherein at least first and second axially extending rows of the energy storage members are provided wherein the energy storage members are provided in an array having first and second lateral array sides which are spaced apart in a lateral direction, first and second transverse array sides which are spaced apart in a transverse direction that is perpendicular to both the motor axis of rotation and the lateral direction, and first and second axially spaced apart array sides, wherein the first axially extending row of energy storage members is located at the first transverse array side and the second axially extending row is located at the second transverse array side, wherein a first portion of a filter is positioned between the second transverse array side and the first axially extending row of energy storage members.

10. The hand vacuum cleaner of claim 9 wherein the filter is positioned overlying at least one of the first and second axially extending rows of energy storage members.

11. The hand vacuum cleaner of claim 10 wherein the filter is a pre-motor filter, the axis of rotation extends through a volume defined by a perimeter of the pre-motor filter and a second portion of the filter is positioned between the first and second axially extending rows of energy storage members.

12. The hand vacuum cleaner of claim 10 further comprising a post-motor filter and the axis of rotation extends through a volume defined by a perimeter of the post-motor filter.

13. The hand vacuum cleaner of claim 12 wherein an axis of at least one of the first and second axially extending rows of energy storage members extends through the volume defined by the perimeter of the post-motor filter.

14. The hand vacuum cleaner of claim 9 wherein the axis of rotation extends through a volume defined by a perimeter of the filter.

15. A hand vacuum cleaner having a front end, a rear end, an upper end and a lower end, the hand vacuum cleaner comprising:

(a) a hand vacuum cleaner air flow path extending from a hand vacuum cleaner air inlet to a clean air outlet with an air treatment member and a fan and motor assembly in the air flow path, the fan and motor assembly assembly having a motor axis of rotation, the hand vacuum cleaner air flow path having an upstream portion that extends from the hand vacuum cleaner air inlet to a location upstream of the fan and motor assembly;

(b) a hand vacuum cleaner body;

(c) a handle having a hand grip portion; and, (d) a plurality of energy storage members wherein at least a portion of the fan and motor assembly is located between at least some of the energy storage members and wherein the plurality of energy storage members are located in a housing, the housing having a battery housing air flow path therethrough extending from a housing air inlet to a housing air outlet and the housing air flow path is fluidically isolated from the upstream portion of the hand vacuum cleaner air flow path.

16. A hand vacuum cleaner having a front end, a rear end, an upper end and a lower end, the hand vacuum cleaner comprising:

(a) an air flow path from an air inlet to a clean air outlet with an air treatment member and a fan and motor assembly in the air flow path, the motor and fan assembly having a motor axis of rotation;

(b) a hand vacuum cleaner body;

(c) a handle having a hand grip portion; and, (d) a plurality of energy storage members are located in a removable housing that forms a portion of the exterior surface of the hand vacuum cleaner, wherein the removable housing is removable while the fan and motor assembly remains in position in the hand vacuum cleaner, wherein at least first and second laterally spaced apart axially extending rows of the energy storage members are provided;

wherein a filter is provided in the air flow path and the filter is transversely positioned overlying at least one of the first and second axially extending rows of energy storage members; and wherein the filter is a pre-motor filter, the axis of rotation extends through a volume defined by a perimeter of the pre-motor filter and first portion of the filter is positioned between the first and second axially extending rows of energy storage members.

17. A hand vacuum cleaner having a front end, a rear end, an upper end and a lower end, the hand vacuum cleaner comprising:

(a) an air flow path from an air inlet to a clean air outlet with a cyclone and a fan and motor assembly in the air flow path, the motor and fan assembly having a motor axis of rotation and the cyclone having a cyclone axis of rotation wherein the cyclone axis of rotation and the motor axis of rotation are generally parallel;

(b) a handle having a hand grip portion;

(c) a hand vacuum cleaner body and the cyclone axis of rotation extends through the handle; and, (d) a plurality of energy storage members wherein the plurality of energy storage members are located in a removable housing that forms a portion of the exterior surface of the hand vacuum cleaner, wherein the removable housing is removable while the fan and motor assembly remains in position in the hand vacuum cleaner, wherein an open volume is provided between at least some of the energy storage members and at least a portion of a filter is located in the open volume.

18. A hand vacuum cleaner having a front end, a rear end, an upper end and a lower end, the hand vacuum cleaner comprising:

(a) an air flow path from an air inlet to a clean air outlet with a cyclone and a fan and motor assembly in the air flow path, the motor and fan assembly having a motor axis of rotation and the cyclone having a cyclone axis of rotation wherein the cyclone axis of rotation and the motor axis of rotation are generally parallel;

(b) a handle having a hand grip portion;

(c) a hand vacuum cleaner body and the cyclone axis of rotation extends through the handle; and, (d) a plurality of energy storage members wherein the plurality of energy storage members are located in a removable housing that forms a portion of the exterior surface of the hand vacuum cleaner, wherein the removable housing is removable while the fan and motor assembly remains in position in the hand vacuum cleaner, wherein the motor and fan assembly has first and second lateral sides which are spaced apart in a lateral direction on opposite sides of the motor axis of rotation and the removable housing is generally U-shaped with each of the first and second lateral sides of the removable housing having an axially extending lateral side portion which contains some of the plurality of energy storage members.

19. The hand vacuum cleaner of claim 18 wherein the removable housing further comprises a base portion that extends between the lateral side portions and the base portion has an absence of energy storage members.

* * * * *